US007090701B2

(12) United States Patent
Cardamone et al.

(10) Patent No.: US 7,090,701 B2
(45) Date of Patent: Aug. 15, 2006

(54) METHODS OF IMPROVING SHRINK-RESISTANCE OF NATURAL FIBERS, SYNTHETIC FIBERS, OR MIXTURES THEREOF, OR FABRIC OR YARN COMPOSED OF NATURAL FIBERS, SYNTHETIC FIBERS, OR MIXTURES THEREOF

(75) Inventors: Jeanette M. Cardamone, Lafayette Hill, PA (US); Jiming Yao, Toronto (CA)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 164 days.

(21) Appl. No.: 10/730,208

(22) Filed: Dec. 8, 2003

(65) Prior Publication Data

US 2004/0261192 A1 Dec. 30, 2004

Related U.S. Application Data

(60) Provisional application No. 60/495,395, filed on Aug. 15, 2003, provisional application No. 60/483,991, filed on Jun. 30, 2003.

(51) Int. Cl.
*D06M 3/02* (2006.01)
*D06M 13/248* (2006.01)
*D06M 13/402* (2006.01)

(52) U.S. Cl. ..... 8/111; 8/137; 8/128.1; 8/128.3; 8/115.51; 8/115.6; 8/115.7; 8/115.66; 8/192

(58) Field of Classification Search ..... 8/111, 8/137, 128.1, 128.3, 115.1, 115.66, 192
See application file for complete search history.

(56) References Cited

U.S. PATENT DOCUMENTS

| | | | | |
|---|---|---|---|---|
| 3,702,776 | A * | 11/1972 | Wagner et al. | 442/106 |
| 5,697,983 | A | 12/1997 | Connell et al. | 8/128.3 |
| 6,051,033 | A | 4/2000 | McDevitt et al. | |
| 6,099,588 | A | 8/2000 | McDevitt et al. | 8/128.1 |
| 6,140,109 | A | 10/2000 | McDevitt et al. | 435/263 |
| 6,541,438 | B1 * | 4/2003 | Smets et al. | 510/392 |
| 2002/0007515 | A1 * | 1/2002 | Rizzardi et al. | 8/115.51 |
| 2003/0092598 | A1 * | 5/2003 | Gardner et al. | 510/513 |
| 2003/0154555 | A1 | 8/2003 | Griffin et al. | |
| 2003/0177589 | A1 | 9/2003 | Buchert et al. | |

OTHER PUBLICATIONS

Bell, V.A., et al., "Pad-Batch Polymer Shrink-Resist Processes for Wool Fabrics", *Proceedings of the 7th International Wool Textile Research Conference*, Tokyo, IV, pp. 292-301 (1985).

Bellamy, L.J., "The Infra-red Spectra of Complex Molecules", New York: *John Wiley Press*, pp. 163-164, 167, 173 (1966).

Bourn, A., et al., "Developments cap In Continuous Shrink Resist Processing", *Proceedings of the 7th International Wool Textile Research Conference*, Tokyo, IV, pp. 272-279 (1985).

Byrne, K.M., et al., "Soft Finishes for Wool", *Proc. Textile Fashioning the Future*, The Textile Institute, U.K., pp. 317-325 (1989).

Cegarra, J., et al., "The Bleaching of Wool with Hydrogen Peroxide", *Wool Science Review 59*, International Wool Secretariat, Yorks (1983).

Choplin, H., "Introduction to the Proteases, University of Tours": Francois Rabelais, http://delphi.phys.univ-tours.fr/Prolysis/Introprotease.html (1999).

Cockett, K.R.F., et al., "Developments in the Shrinkproofing of Wool to the Superwash Standard", *Proc. 6th International Wool Research Conference*, Petoria, S. Africa, V1, pp. 1-16 (1980).

Cockett, K.R.F., et al., "Production of Superwash Knitwear by Batch Processing Routes", *Wool Science* Review 56, International Wool Scretariat, Ilkley, pp. 3-44 (1980).

Cockett, K.R.F., et al., "The Development of Polymer Exhaust Aqueous Batch Processes to Meet the Superwash Standard", *JSDC*, vol. 96, pp. 214-223 (May 1980).

Davidson, A.N., et al., "Shrink-resisting Wool: Some Novel Features and the Description of a New Process", *J. Text. Inst.*, vol. 47, pp. 685-703 (1956).

El-Sayed, H., et al., "Developing a Zero-AOX Shrink-resist Process for Wool, Part 1: Preliminary Results", *Coloration Technology*, vol. 117(4), pp. 234-238 (2001).

(Continued)

*Primary Examiner*—Margaret Einsmann
*Assistant Examiner*—Amina Khan
(74) *Attorney, Agent, or Firm*—John D. Fado; G. Byron Stover

(57) ABSTRACT

Methods of improving shrink-resistance of natural fibers (e.g., wool, wool fibers, animal hair, cotton), synthetic fibers (e.g., acetate, nylon, polyester, viscose rayon), or blends thereof (e.g., wool/cotton blends), or fabrics or yarns composed of natural fibers, synthetic fibers, or blends thereof, involving contacting the fibers (or fabric or yarn) with NaOH, $H_2O_2$, gluconic acid, dicyandiamide, and non-ionic surfactant (e.g., Triton X surfactant such as Triton X-100 and preferably Triton X-114), and optionally subsequently contacting the fibers (or fabric or yarn) with protease and non-ionic surfactant and optionally sodium sulfite and optionally triethanolamine and optionally polyacrylamide polymer. The methods do not utilize dichloroisocyanuric acid, chloroamines, peroxymonosulfuric acid, monoperoxyphthalic acid, permanganate, chlorine gas, sodium hypochlorite, or aminoplast resins.

21 Claims, 29 Drawing Sheets

OTHER PUBLICATIONS

Evans, D.J., et al., "Cleavage of Integral Surface Lipids of Wool by Aminolysis", *Textile Res. J.*, vol. 67(6), pp. 435-444 (Jun. 1997).
Evans, D.J., et al., "Separation and Analysis of the Surface Lipids of the Wool Fiber", *Proceedings of the 7th International Wool Textile Research Conference*, Tokyo, vol. 1, pp. 135-142 (1985).
Fornelli, S., "The Enzymatic Big Bang for the Textile Industry", *Sandoz Chemicals, LTD. 05994.00.94e*, Muttenz, Switzerland, vol. 36, pp. 37 (1994).
Gerhartz, W. (Ed.), *Enzymes In Industry*, "VCH Verlagsgesellschaft mbH, D-6940 Weinheim", Germany (1990).
Gulse, G.B., et al., "The Chemistry of a Polyamide-Epichlorohydrin Resin (Hercosett 125) Used to Shrink-resist Wool",). Applied Polymer Science, vol. 30(10), pp. 4099-4111 (1985).
Hanekom, E.C., et al., "An Improved Process for the Chlorination of Wool with DCCA", *Sawtri Bulletin*, vol. 8(2), pp. 19-21 (Jun. 1974).
Jovancic, J.D., et al., "The Efficiency of an Enzyme Treatment in Reducing Wool Shrinkage", *J. Textile Inst.*, vol. 89(2) Part 1, pp. 390-400 (1998).
Leeder, J.D., et al., "Modification of the Surface of Wool by Treatment with Anhydrous Alkail", *Proceedings of the 7th International Wool Textile Research Conference*, Tokyo, IV, pp. 312-321 (1985).
Levene, R., et al., "Applying Proteases to Confer Improved Shrink-resistance to Wool", *J. Soc. Dyers Colourists*, vol. 112(1), pp. 6-10 (Jan. 1996).
Lewis, J., "Continuous Shrinkproofing Process", *Wool Science Review*, vol. 55, pp. 23-42 (May 1978).
Lewis, J., "Superwash Wool, Part 1", *Wool Science Review*, vol. 54, pp. 3-29 (Sep. 1977).
Lipson, M., "Unshrinkable Wool Produced by Alcoholic Alkali", *J. Textile Inst.*, vol. 38(8), pp. 279-285 (Aug. 1947).
Mehta, R.D., "Shrinking of Wool Using a Low Energy Cure Acrylic Polymer", *Proceedings of the 7th International Wool Textile Research Conference*, Tokyo, IV, pp. 262-271 (1985).
O'Connor, R.T., et al., "The Infrared Spectra of Saturated Fatty Acids with Even Number of Carbon Atoms from Caproic, C6 (Hexanoic), to Steraic, C18 (Octadecanoic), and Their Methyl and Ethyl Esters", *J. Amer. Oil Chem. Soc.*, vol. 28(4), pp. 154-160 (1951).
Rutley, R.O., "Shrink-resist Finishing of Wool Materials with Polyurethane", *J. Soc. Dyers Colourists*, vol. 86(8), pp. 337-345 (Aug. 1970).
Sinclair, R.G., et al., "The Infrared Absorption of Saturated Fatty Acids and Esters", *J. Amer. Chem. Soc.*, vol. 74(10), pp. 2570-2578 (May 1952).
Stigter, D., "On the Correlation Between the Surface Chemistry and the Felting Behavior of Wool", *J. Amer. Oil. Chem. Soc.*, vol. 48(7), pp. 340-343 (Jul. 1971).
Sun, K., et al., "Anti-Felting Finishing of Wool by Protease with a Hydrogen Peroxide Pretreatment", *Book of Papers 1998 International AATCC Conference & Exhibition*, Philadelphia, pp. 299-309 (Sep. 22-25, 1998).
Sweetman, E.J., et al., "Chemical Reactions Involved in the Shrinkproofing of Wool by Oxidation—Sulfite Processes", *Textile Res. J.*, vol. 35(4), pp. 315-322 (Apr. 1965).
Van Rensburg, N., et al., "The SAWTRI Continuous Shrink-resist Process", *Proceedings of the 7th International Textile Wool Research Conference*, Tokyo, IV, pp. 302-311 (1985).
Weck, M., "Wasserstoffperoxid-das umweltvertragliche Textillbleichmittel", *Textile Praxis International*, vol. 53, pp. 144-147 (Feb. 1991).
Weldeman, E., et al., "A Note on the Effect of Various Additives on the Shrinkage of Wool Fabrics Treated with P.A.E. Resins", *SAWTRI Bulletin*, vol. 10(2), pp. 22-26 (Jun. 1976).
Weldeman, E., et al., "Use of DCCA/Polyamide Epichlorohydrin Resin Process for Rendering Wool tops Shrinkresistant", *SAWTRI Bulletin*, vol. 8(2), pp. 22-27 (Jun. 1974).
Wood, F.C., "Non-felting Wool and Wool Mixtures", *J. Soc. Dyers Colourists*, vol. 68(12), pp. 485-495 (Dec. 1952).
Zahn, H., et al., "Covalently Linked Fatty Acids at the Surface of Wool: Part of the Cuticle Cell Envelope", *Textile Res. J.*, vol. 64(9), pp. 554-555 (Sep. 1994).
Jones, R., et al., "Band Progressions in the Infrared Spectra of Fatty Acids and Related Compounds", *J. Amer. Chem. Soc.*, vol. 74, pp. 2575-2578 (May 1952).
Sinclair, R.G., et al., "The Infrared Absorption Spectra of Unsaturated Fatty Acids and Esters", *J. Amer. Chem. Soc.*, vol. 74, pp. 2578-2585 (May 1952).
Weideman, E., et al., "The Use of DCCA and Polyamide-Epichlorohydrin Polyacrylate Resins for Rendering Woven Wool Fabrics Shrink-resistant", SAWTRI Bulletin, vol. 8(2), pp. 28-35 (Jun. 1974).
Bell, V.A., et al., "Pad-Batch Polymer Shrink-Resist Processes for Wool Fabrics", *Proceedings of the 7th International Wool Textile Research Conference*, Tokyo, IV, pp. 292-301 (1985).
Bellamy, L.J., "The Infra-red Spectra of Complex Molecules", New York: *John Wiley Press*, pp. 163-164, 167, 173 (1966).
Bourn, A., et al., "Developments in Continuous Shrink Resist Processing", *Proceedings of the 7th International Wool Textile Research Conference*, Tokyo, IV, pp. 272-279 (1985).
Byrne, K.M., et al., "Soft Finishes for Wool", *Proc. Textile Fashioning the Future*, The Textile Institute, U.K., pp. 317-325 (1989).
Cegarra, J., et al., "The Bleaching of Wool with Hydrogen Peroxide", *Wool Science Review 59*, International Wool Secretariat, Yorks (1983).
Choplin, H., "Introduction to the Proteases, University of Tours": Francois Rabelais, http://delphi.phys.univ-tours.fr/Prolysis/introprotease.html (1999).
Cockett, K.R.F., et al., "Developments in the Shrinkproofing of Wool to the Superwash Standard", *Proc. 6th International Wool Research Conference*, Petoria, S. Africa, V1, pp. 1-16 (1980).
Cockett, K.R.F., et al., "Production of Superwash Knitwear by Batch Processing Routes", *Wool Science Review 56*, International Wool Secretariat, likely, pp. 3-44 (1980).
Cockett, K.R.F., et al., "The Development of Polymer Exhaust Aqueous Batch Processes to Meet the Superwash Standard", *JSDC*, vol. 96, pp. 214-223 (May 1980).
Davidson, A.N., et al., "Shrink-resisting Wool: Some Novel Features and the Description of a New Process", *J. Text. Inst.*, vol. 47, pp. 685-703 (1956).
El-Sayed, H., et al., "Developing a Zero-AOX Shrink-resist Process for Wool, Part 1: Preliminary Resuits, *Coloration Technology*", vol. 117(4), pp. 234-238 (2001).
Evans, D.J., et al., "Cleavage of Integral Surface Lipids of Wool by Aminolysis", *Textile Res. J.*, vol. 67(6), pp. 435-444 (Jun. 1997).

Evans, D.J., et al., "Separation and Analysis of the Surface Lipids of the Wool Fiber", *Proceedings of the 7th International Wool Textile Research Conference*, Tokyo, vol. 1, pp. 135-142 (1985).
Fornelli, S., "The Enzymatic Big Bang for the Textile Industry", *Sandoz Chemicals, LTD. 05994.00.94e*, Muttenz, Switzerland, vol. 36, pp. 37 (1994).
Gerhartz, W. (Ed.), *Enzymes in Industry*, VCH Verlagsgesellschaft mbH, D-6940 Weinheim, Germany (1990).
Guise, G.B., et al., "The Chemistry of a Polyamide-Epichlorohydrin Resin (Hercosett 125) Used to Shrink-resist Wool", *J. Applied Polymer Science*, vol. 30(10), pp. 4099-4111 (1985).
Hanekorn, E.C., et al., "An Improved Process for the Chlorination of Wool with DCCA", *SAWTRI Bulletin*, vol. 8(2), pp. 19-21 (Jun. 1974).
Jovancic, J.D., et al., "The Efficiency of an Enzyme Treatment in Reducing Wool Shrinkage", *J. Textile Inst.*, vol. 89(2) Part 1, pp. 390-400 (1998).
Leeder, J.D., et al., "Modification of the Surface of Wool by Treatment with Anhydrous Alkall", *Proceedings of the 7th International Wool Textile Research Conference*, Tokyo, IV, pp. 312-321 (1985).
Levene, R., et al., "Applying Proteases to Confer Improved Shrink-resistance to Wool", *J. Soc. Dyers Colourists*, vol. 112(1), pp. 6-10 (Jan. 1996).
Lewis, J., "Continuous Shrinkproofing Process", *Wool Science Review*, vol. 55, pp. 23-42 (May 1978).
Lewis, J., "Superwash Wool, Part 1", *Wool Science Review*, vol. 54, pp. 3-29 (Sep. 1977).
Lipson, M., "Unshrinkable Wool Produced by Alcoholic Alkall", *J. Textile Inst.*, vol. 38(8), pp. 279-285 (Aug. 1947).
Mehta, R.D., "Shrinking of Wool Using a Low Energy Cure Acrylic Polymer", *Proceedings of the 7th International Wool Textile Research Conference*, Tokyo, IV, pp. 262-271 (1985).
O'Connor, R.T., et al., "The Infrared Spectra of Saturated Fatty Acids with Even Number of Carbon Atoms from Caproic, C6 (Hexanoic), to Stearlc, C18 (Octadecanoic), and Their Methyl and Ethyl Esters", *J. Amer. Oil Chem. Soc.*, vol. 28(4), pp. 154-160 (1951).
Rutley, R.O., "Shrink-resist Finishing of Wool Materials with Polyurethane", *J. Soc. Dyers Colourists*, vol. 86(8), pp. 337-345 (Aug. 1970).
Sinclair, R.G., et al., "The Infrared Absorption of Saturated Fatty Acids and Esters", *J. Amer. Chem. Soc.*, vol. 74(10), pp. 2570-2578 (May 1952).
Stigter, D., "On the Correlation Between the Surface Chemistry and the Felting Behavior of Wool", *J. Amer. Oil. Chem. Soc.*, vol. 48(7), pp. 340-343 (Jul. 1971).
Sun, K., et al., "Anti-Felting Finishing of Wool by Protease with a Hydrogen Peroxide Pretrement", *Book of Papers 1998 International AATCC Conference & Exhibition*, Philadelphia, pp. 299-309 (Sep. 22-25, 1998).
Sweetman, F.J., et al., "Chemical Reactions Involved in the Shrinkproofing of Wool by Oxidation -Sulfite Processes", *Textile Res. J.*, vol. 35(4), pp. 315-322 (Apr. 1965).
Van Rensburg, N., et al., "The SAWTRI Continuous Shrink-resist Process", *Proceedings of the 7th International Textile Wool Research Conference*, Tokyo, IV, pp. 302-311 (1985).
Weck, M., "Wasserstoffperoxid-das umweltvertragliche Textilbleichmittel", *Textile Praxis International*, vol. 53, pp. 144-147 (Feb. 1991).
Weldeman, E., et al., "A Note on the Effect of Various Additives on the Shrinkage of Wool Fabrics Treated with P.A.E. Resins", *SAWTRI Bulletin*, vol. 10(2), pp. 22-26 (Jun. 1976).
Weideman, E., et al., "Use of DCCA/Polyamide Epichlorohydrin Resin Process for Rendering Wool tops Shrinkresistant", *SAWTRI Bulletin*, vol. 8(2), pp. 22-27 (Jun. 1974).
Wood, F.C., "Non-Felting Wool and Wool Mixtures", *J. Soc. Dyers Colourists*, vol. 68(12), pp. 485-495 (Dec. 1952).
Zahn, H., et al., "Covalently Linked Fatty Acids at the Surface of Wool: Part of the Cuticle Cell Envelope", *Textile Res. J.*, vol. 64(9), pp. 554-555 (Sep. 1994).
Jones, R., et al., "Band Progressions in the Infrared Spectra of Fatty Acids and Related Compounds", *J. Amer. Chem. Soc.*, vol. 74, pp. 2575-2578 (May 1952).
Sinclair, R.G., et al., "The Infrared Absorption Spectra of Unsaturated Fatty Acids and Esters", *J. Amer. Chem. Soc.*, vol. 74, pp. 2578-2585 (May 1952).
Weldeman, E., et al., "The Use of DCCA and Polyamide-Epichlorohydrin Polyacrylate Resins for Rendering Woven Wool Fabrics Shrink-resistant", SAWTRI Bulletin, vol. 8(2), pp. 28-35 (Jun. 1974).

* cited by examiner

E

F

METHODS OF IMPROVING SHRINK-RESISTANCE OF NATURAL FIBERS, SYNTHETIC FIBERS, OR MIXTURES THEREOF, OR FABRIC OR YARN COMPOSED OF NATURAL FIBERS, SYNTHETIC FIBERS, OR MIXTURES THEREOF

REFERENCE TO RELATED APPLICATION

This application claims the benefit of U.S. Provisional Application No. 60/483,991, filed 30 Jun. 2003, and U.S. Provisional Application No. 60/495,395, filed 15 Aug. 2003, which are incorporated herein by reference in their entirety.

BACKGROUND OF THE INVENTION

The present invention concerns methods of improving shrink-resistance of natural fibers (e.g., wool, wool fibers, animal hair, cotton), synthetic fibers (e.g., acetate, nylon, polyester, viscose rayon), or blends thereof (e.g., wool/cotton blends), or fabrics or yarns composed of natural fibers, synthetic fibers, or blends thereof, involving contacting the fibers (or fabric or yarn) with NaOH, $H_2O_2$, gluconic acid, dicyandiamide, and non-ionic surfactant (e.g., Triton X surfactant such as Triton X-100 and preferably Triton X-114), and optionally subsequently contacting the fibers (or fabric or yarn) with protease and non-ionic surfactant and optionally sodium sulfite and optionally triethanolamine and optionally polyacrylamide polymer. The methods do not utilize dichloroisocyanuric acid, chloroamines, peroxymonosulfuric acid, monoperoxyphthalic acid, permanganate, chlorine gas, sodium hypochlorite, or aminoplast resins.

The demand for shrinkage resistance in wool products has led to the development of effective chlorinated systems. However, the perceived drawback to their use is the production of adsorbable organic halogens (AOX). Thus alternative systems relying upon other compounds are now under investigation.

We now report on $H_2O_2$ processes, some with protease enzyme, and the selectivity of these processes to remove wool's hydrophobic layer and form anionic surface charge while causing scale smoothing to achieve shrinkage control. We also investigated alkaline peroxide/gluconic acid/dicyandiamide pretreatment followed by application of protease in buffered triethanolamine solution to which sodium sulfite was added.

SUMMARY OF THE INVENTION

The present invention concerns methods of improving shrink-resistance of natural fibers (e.g., wool, wool fibers, animal hair, cotton), synthetic fibers (e.g., acetate, nylon, polyester, viscose rayon), or blends thereof (e.g., wool/cotton blends), involving contacting the fibers with NaOH, $H_2O_2$, gluconic acid, dicyandiamide, and non-ionic surfactant (e.g., Triton X surfactant such as Triton X-100 and preferably Triton X-114), and optionally subsequently contacting the fibers with protease and non-ionic surfactant and optionally sodium sulfite and optionally triethanolamine and optionally polyacrylamide polymer. The methods do not utilize dichloroisocyanuric acid, chloroamines, peroxymonosulfuric acid, monoperoxyphthalic acid, permanganate, chlorine gas, sodium hypochlorite, or aminoplast resins.

The natural fibers (e.g., wool, wool fibers, animal hair, cotton), synthetic fibers (e.g., acetate, nylon, polyester, viscose rayon), or blends thereof (e.g., wool/cotton blends) may be in the form of fabric or yarn. Thus the present invention concerns methods of improving shrink-resistance of fabrics or yarn of natural fibers (e.g., wool, wool fibers, animal hair, cotton), synthetic fibers (e.g., acetate, nylon, polyester, viscose rayon), or blends thereof (e.g., wool/cotton blends), involving contacting the fabric or yarn with NaOH, $H_2O_2$, gluconic acid, dicyandiamide, and non-ionic surfactant (e.g., Triton X surfactant such as Triton X-100 and preferably Triton X-114), and optionally subsequently contacting the fabric or yarn with protease and non-ionic surfactant and optionally sodium sulfite and optionally triethanolamine and optionally polyacrylamide polymer. The methods do not utilize dichloroisocyanuric acid, chloroamines, peroxymonosulfuric acid, monoperoxyphthalic acid, permanganate, chlorine gas, sodium hypochlorite, or aminoplast resins.

One aspect of the present invention involves contacting the fibers (or fabrics or yarn) with NaOH, $H_2O_2$, gluconic acid, dicyandiamide, and non-ionic surfactant (e.g., Triton X-100), and subsequently contacting the fibers (or fabrics or yarn) with protease and optionally sodium sulfite and optionally triethanolamine and optionally polyacrylamide polymer.

Another aspect of the present invention involves contacting the fibers (or fabrics or yarn) with NaOH, $H_2O_2$, gluconic acid, dicyandiamide, and non-ionic surfactant (e.g., Triton X-114) but not protease.

One preferred aspect of the present invention involves contacting the fibers (or fabrics or yarn) with NaOH, $H_2O_2$, gluconic acid, dicyandiamide, and non-ionic surfactant (e.g., Triton X-114), and subsequently contacting the fibers (or fabrics or yarn) with protease, sodium sulfite, triethanolamine, and non-ionic surfactant (e.g., Triton X-114), and optionally polyacrylamide polymer.

DETAILED DESCRIPTION OF THE INVENTION

Figure 1:
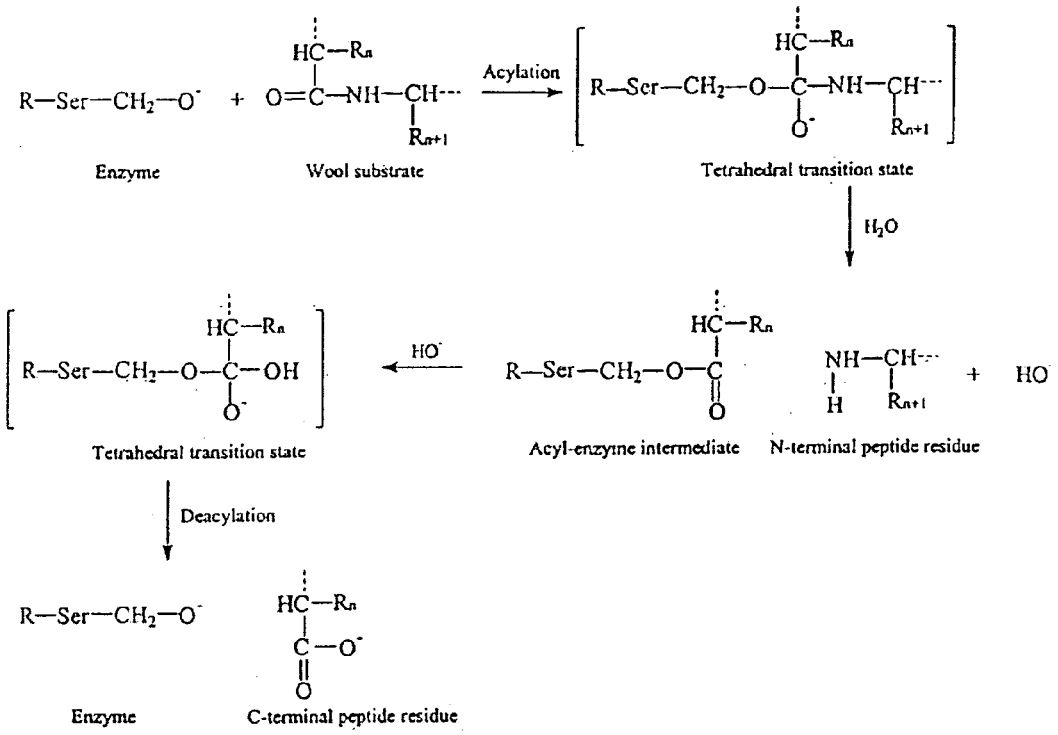
FIG. 1 shows the catalytic mechanism of serine proteinases.

The present invention concerns methods of improving shrink-resistance of natural fibers (e.g., wool, wool fibers, animal hair, cotton), synthetic fibers (e.g., acetate, nylon, polyester, viscose rayon), or blends thereof (e.g., wool/cotton blends), or fabrics or yarns composed of natural fibers, synthetic fibers, or blends thereof, involving contacting the fibers (or fabric or yarn) with NaOH, $H_2O_2$, gluconic acid, dicyandiamide, and non-ionic surfactant (e.g., Triton X surfactant such as Triton X-100 and preferably Triton X-114), and optionally subsequently contacting the fibers (or fabric or yarn) with protease and non-ionic surfactant and optionally sodium sulfite and optionally triethanolamine and optionally polyacrylamide polymer. The methods do not utilize dichloroisocyanuric acid, chloroamines, peroxymonosulfuric acid, monoperoxyphthalic acid, permanganate, chlorine gas, sodium hypochlorite, or aminoplast resins.

One aspect of the present invention involves contacting the fibers (or fabrics or yarn) with NaOH, $H_2O_2$, gluconic acid, dicyandiamide, and non-ionic surfactant (e.g., Triton X-100), and subsequently contacting the fibers (or fabrics or yarn) with protease and optionally sodium sulfite and optionally triethanolamine and optionally polyacrylamide polymer.

Another aspect of the present invention involves contacting the fibers (or fabrics or yarn) with NaOH, $H_2O_2$, gluconic acid, dicyandiamide, and non-ionic surfactant (e.g., Triton X-114) but not protease.

One preferred aspect of the present invention involves contacting the fibers (or fabrics or yarn) with NaOH, $H_2O_2$, gluconic acid, dicyandiamide, and non-ionic surfactant (e.g., Triton X-114), and subsequently contacting the fibers (or fabrics or yarn) with protease, sodium sulfite, triethanolamine, and non-ionic surfactant (e.g., Triton X-114), and optionally polyacrylamide polymer.

Nonionic surfactants that may be utilized in the present invention include Sigma's Triton® X-series prepared by the reaction of octylphenol with ethylene oxide which produces alkylaryl polyether alcohols having the following general structural formula:

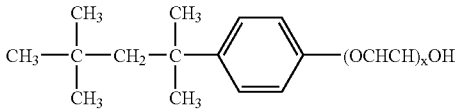

in which x indicates the average number of ethylene oxide units in the ether side-chain, x can range from 1 up to about 70. The Triton® X-series is composed of several products having different lengths of the polyethylene chain. Examples of the Triton® X-series include X-100 (9 to 10 ethylene oxide units per molecule in the ether side chain, 1% solution cloud point, 65° C.) and Triton X-114 (7 to 8 ethylene oxide units in the ether side chain, 1% solution cloud point, 22° C.). The products of the Triton® X-series are mixtures with respect to the polyethylene chain; the number of ethylene oxide units in the ether side chain (e.g., 7 to 8 ethylene oxide units for Triton X-114) represents the average number of ethylene oxide units in the ether side chain (the distribution of polyethylene chain lengths follows the Poisson distribution).

The fibers (or fabrics or yarn) are first treated, involving contacting the fibers (or fabrics or yarn) with NaOH, $H_2O_2$, gluconic acid, dicyandiamide, and non-ionic surfactant (e.g., Triton X surfactant such as Triton X-100 and preferably Triton X-114). The reaction time is generally between about 30 minutes and about 60 minutes (e.g., 30–60 minutes), preferably between about 30 minutes and about 45 minutes (e.g., 30–45 minutes), more preferably between about 30 minutes and about 40 minutes (e.g., 30–40 minutes), and most preferably for about 30 minutes (e.g., 30 minutes). The reaction temperature is generally between about 30° C. and about 45° C. (e.g., 30° C.–45° C.), preferably between about 30° C. and about 40° C. (e.g., 30° C.–40° C.), more preferably between about 30° C. and about 35° C. (e.g., 30° C.–35° C.), and most preferably about 30° C. (e.g., 30° C.). The pH is generally between about 9 and about 12 (e.g., 9–12), preferably between about 10 and about 12 (e.g., 10–12), more preferably between about 11 and about 12 (e.g., 11–12), and most preferably about 11 (e.g., 11). The concentration of NaOH (% owb) is generally between about 2.5 and about 4 g/l (e.g., 2.5–4 g/l), preferably between about 3 and about 4 g/l (e.g., 3–4 g/l), more preferably between about 3 and about 3.5 g/l (e.g., 3–3.5 g/l), and most preferably about 3 g/l (e.g., 3 g/l). The concentration of Na gluconic acid (% owb) is generally between about 0.75 and about 1.75 g/l (e.g., 0.75–1.75 g/l), preferably between about 1 and about 1.75 g/l (e.g., 1–1.75 g/l), more preferably between about 1 and about 1.25 g/l (e.g., 1–1.25 g/l), and most preferably about 1 g/l (e.g., 1 g/l). The concentration of dicyandiamide (% owb) is generally between about 2.5 and about 4 g/l (e.g., 2.5–4 g/l), preferably between about 3 and about 4 g/l (e.g., 3–4 g/l), more preferably between about 3 and about 3.5 g/l (e.g., 3–3.5 g/l), and most preferably about 3 g/l (e.g., 3 g/l). The concentration of non-ionic surfactant (e.g., Triton X surfactant such as Triton X-100 and preferably Triton X-114)(% owb) is generally between about 1 and about 2 g/l (e.g., 1–2 g/l), preferably between about 1.5 and about 2 g/l (e.g., 1.5–2 g/l), more preferably between about 1.75 and about 2 g/l (e.g., 1.75–2 g/l), and most preferably about 2 g/l (e.g., 2 g/l). The concentration of 30% $H_2O_2$ (% owb) is generally between about 10 and about 25 ml/l (e.g., 10–25 ml/l), preferably between about 15 and about 25 ml/l (e.g., 15–25 ml/l), more preferably between about 15 and about 20 ml/l (e.g., 15–20 ml/l), and most preferably about 20 ml/l (e.g., 20 ml/l); if 50% $H_2O_2$ (% owb) is used then the amounts are about ⅔ of the 30% $H_2O_2$.

If the fibers (or fabrics or yarn) are subsequently treated with protease, then the reaction time is generally between about 35 minutes and about 50 minutes (e.g., 35–50 minutes), preferably between about 40 minutes and about 50 minutes (e.g., 40–50 minutes), more preferably between about 40 minutes and about 45 minutes (e.g., 40–45 minutes), and most preferably for about 40 minutes (e.g., 40 minutes). The reaction temperature is generally between about 40° C. and about 55° C. (e.g., 40° C.–55° C.), preferably between about 40° C. and about 50° C. (e.g., 40° C.–50° C.), more preferably between about 45° C. and about 50° C. (e.g., 45° C.–50° C.), and most preferably about 45° C. (e.g., 45° C.). The pH is generally between about 6 and about 8 (e.g., 6–8), preferably between about 6.5 and about 8 (e.g., 6.5–8), and more preferably between about 7 and about 8 (e.g., 7–8). The concentration of triethanolamine (% owb) is generally between about 1.25 and about 2 g/l (e.g., 1.25–2 g/l), preferably between about 1.25 and about 1.75 g/l (e.g., 1.25–1.75 g/l), more preferably between about 1.5 and about 1.75 g/l (e.g., 1.5–1.75 g/l), and most preferably about 1.5 g/l (e.g., 1.5 g/l). The concentration of non-ionic surfactant (e.g., Triton X surfactant such as Triton X-100 and preferably Triton X-114)(% owb) is generally between about 0.3 and about 1.5 g/l (e.g., 0.3–1.5 g/l), preferably between about 0.5 and about 1.5 g/l (e.g., 0.5–1.5 g/l), more preferably between about 0.5 and about 1 g/l (e.g., 0.5–1 g/l), and most preferably about 1 g/l (e.g., 1 g/l). The concentration of protease (e.g., Esperase)(% ow) is generally between about 1.25 and about 2 g/l (e.g., 1.25–2 g/l), preferably between about 1.25 and about 1.75 g/l (e.g., 1.25–1.75 g/l), more preferably between about 1.5 and about 1.75 g/l (e.g., 1.5–1.75 g/l), and most preferably about 1.5 g/l (e.g., 1.5 g/l). The concentration of sodium sulfite (% owf) is generally between about 1.25 and about 2 g/l (e.g., 1.25–2 g/l), preferably between about 1.25 and about 1.75 g/l (e.g., 1.25–1.75 g/l), more preferably between about 1.5 and about 1.75 g/l (e.g., 1.5–1.75 g/l), and most preferably about 1.5 g/l (e.g., 1.5 g/l).

Unless defined otherwise, all technical and scientific terms used herein have the same meaning as commonly understood by one of ordinary skill in the art to which the invention belongs.

The term "shrinkage" refers to the felting shrinkage of fibers as defined in IWS TM 31, i.e., felting shrinkage is the irreversible shrinkage caused by progressive entanglement of the wool fibers induced by washing in an aqueous solution, and is defined as the reduction in length and/or width induced by washing. Shrinkage can be measured in accordance with IWS TM 31, or it can be measured using the following modification. Wool samples (24 cm.times.24 cm) are sewed around the edges and inscribed with a rectangle (18 cm.times. 18 cm). Samples are treated, air-dried, then subjected to five cycles of machine washing and drying (warm wash, high heat of drying) in combination with external ballast such as towels and articles of clothing. The dimensions of the rectangle are measured after five cycles, and the shrinkage is defined as the change in dimensions of the rectangle, after accounting for initial relaxation shrinkage.

The term "shrink-resistance" is a measure of the reduction in shrinkage (as defined above, after wash/dry cycles) for material that has been treated relative to material that has not been treated, i.e., Shrink-resistance=(Shrinkage untreated-Shrinkage treated)/Shrinkage treated The value is multiplied by 100 in order to be expressed as a percentage.

A reduction in shrinkage implies a reduction in felting, and thus all methods that provide improved shrink-resistance also provide "anti-felting" properties.

By the term "wool," "wool fiber," "animal hair," and the like, is meant any commercially useful animal hair product, for example, wool from sheep, camel, rabbit, goat, llama, and known as merino wool, shetland wool, cashmere wool, alpaca wool, mohair, etc. The term "wool" includes the fiber from fleece of the sheep or lamb or hair of the Angora or Cashmere goat (and may include the so-called specialty fibers from the camel, alpaca, llama, and vicuna) which has never been reclaimed from any woven or felted wool product (Federal Trade Commission, Rules and Regulations Under the Textile Fiber Products Identification Act, effective Mar. 3, 1960 as amended Jul. 9, 1986, page 2.)

The methods of the invention can also be used with blends of wool with other natural and synthetic fibers, including but not limited to Cotton, Flax, Rayon, Acetate, Acrylic, Nylon, Olefin, Polyester, Spandex, Aramid, Lyocell, Olefin, Polypropylene, PEEK, PLA, Fluorocarbon, Carbon, Glass, PBI, and others known in the art.

The methods of the invention can be used with natural fibers, synthetic fibers, and mixtures thereof in the form of top, fiber, yarn, or woven or knitted fabric. The methods can also be carried out on loose fiber stock or on yarn, fabrics or garments made from natural fibers, synthetic fibers, and mixtures thereof. The methods can be performed at many different stages of processing, including either before or after dyeing. A range of different chemical additives can be added along with the enzymes, including wetting agents and softeners.

It should be emphasized that wool and other animal hair materials are products of biological origin. The material may vary greatly, e.g., in chemical composition and morphological structure depending on the living conditions and health of the animal. Accordingly, the effect(s) obtained by subjecting wool or other animal hair products to the method of the present invention may vary in accordance with the properties of the starting material.

The following examples are intended only to further illustrate the invention and are not intended to limit the scope of the invention as defined by the claims.

EXAMPLES

First Example

Materials And Methods:

Worsted wool fabrics (Testfabrics Inc.), #523 worsted flannel, as received, were cut to 10 gram sample weights.

D-Gluconic acid, CAS Reg. No. [526–95-4] was supplied by Sigma (St. Louis, Mo.) as the potassium salt of (2,3,4,5,6-pentahydroxycapric acid, 99%). Two nonionic surfactants, having different cloud points (the temperature at which the surfactant drops out of solution, causing the solution to become cloudy) described as alkylaryl polyether alcohols, Triton X-100 (9 to 10 ethylene oxide units per molecule in the ether side chain, 1% solution cloud point, 65° C.) and Triton X-114 (7 to 8 ethylene oxide units, 1% solution cloud point, 22° C.) were supplied by Sigma (St. Louis, Mo.). Under our reaction conditions (30° C. and 40° C.) the solution containing Triton X-100 was clear and the solution containing Triton X-114 was cloudy. Boric acid, dicyandiamide (DD) and hydrogen peroxide ($H_2O_2$), 30%, were obtained from Aldrich (Milwauke, Wis.). Sodium hydroxide (NaOH) was obtained from Mallinckrodt Baker, Inc. (Paris, Ky.) in a lab grade. The alkaline protease, Esperase® 8.0 L, a subtilisin serine protease designed for use in washing powders, was supplied by Novozymes North America. Inc. (Franklinton, N.C.).

Experimental Design: Pretreatment baths contained NaOH, DD, $H_2O_2$, GA and either 2 g/L Triton X-100 or Triton X-114. In certain experiments this pretreatment was followed by 2% of enzyme in borate buffer medium containing 1 g/L either Triton X-100 or Triton X-114. Borate buffers (10 mM, pH 9) were prepared by dissolving 2.48 g of boric acid in 3.7 L water containing Triton X-100 and adjusting the pH to 9.0 with NaOH solution (0.1M). The conditions of application are shown in experiments 1–8 in Table I. We followed a seven-factorial statistical design based on high/low values for pH (X1), concentration (X2), exposure time (X3), and the presence or absence of the four reactants: GA (X4), DD (X5), $H_2O_2$ (X6) and enzyme (X7). Triton X-100 was added to both pretreatment and treatment baths. The statistical scheme is shown in Table I. The relative importance of the factors: pH, LR, time, and the four reactants (from experiments 1 to 8) were determined from their appropriately highest (most important) or lowest (least important) numerical values found from the following equations:

Factor $X1$=(Row 2+Row 4+Row 6+Row 8)−(Row 1+Row 3+Row 5+Row 7)

Factor $X3$=(Row 5+Row 6+Row 7+Row 8)−(Row 1+Row 2+Row 3+Row 4)

Factor $X4$=(Row 1+Row 4+Row 5+Row 8)−(Row 2+Row 3+Row 6+Row 7)

Factor $X5$=(Row 1+Row 3+Row 6+Row 8)−(Row 2+Row 4+Row 5+Row 7)

Factor $X6$=(Row 1+Row 2+Row 7+Row 8)−(Row 3+Row 4+Row 5+Row 6)

Factor $X7$=(Row 2+Row 3+Row 5+Row 8)−(Row 1+Row 4+Row 6+Row 7)

Pretreatment: The pretreatment baths containing 2 g/L Triton X-100 were prepared according to Table I for selected times at 30° C. in an Atlas LP2 Launder-Ometer and Lab Dyeing System. After pretreatment the fabrics were rinsed and squeezed of excess water before placing them in the enzyme treatment baths.

Enzymatic Treatment: Enzymatic treatment baths were prepared according to Table I and carried out for 40 minutes at 45° C. At the end of treatment, the enzyme was inactivated by raising the temperature to 80° C. at 5.5° C./min followed by 10 minutes dwelling at this temperature. After treatment, the samples were rinsed in cold water and air-dried.

Fluorescence Microscopy: Wool yarns were stained at 60° C. for 30 minutes with 0.04 g Rhodamine B (cationic dye) dissolved in 90 mL of ethanol and 10 mL methanol, liquor ratio 40:1. After drying under a stream of nitrogen, the yarns were rinsed in tetrachloroethylene to remove any loosely adsorbed dye and air-dried. Cross-sections of the stained fibers from these yarns were prepared on the Micro No. 200-A Microtome (Micro Instrument, Marshfield Hills, Mass.) using collodion embedding medium (Mallinckrodt, Paris, Ky.) prepared as a solution of 1 mL of collodion dissolved in 5 mL of ethanol and 1 mL of diethylether. Sections of 5 mm thickness were cut and placed on a glass slide and covered by a glass cover slip. Confocal fluorescent images of the stained fiber cross-sections were obtained from a Leica TCS Confocal System equipped with an HCX PL40X 1.25 NA lens. The wavelength of excitation was 488 nm using an 18% acousto optic tunable filter and the emission wavelength was 540–580 nm.

Scanning Electron Microscopy (SEM): Wool yarn lengths, 2.5 cm, were withdrawn from untreated and treated fabrics. The yarns were glued to aluminum specimen stubs using double-sided SEM tape (Electron Microscopy Sciences, Ft. Washington, Pa.), and the mounted samples were coated with a thin layer of gold in a DC sputtering apparatus (Edwards High Vacuum, Wilmington, Mass.) for 240 seconds at 1 kV and 20 mA. Imaging was performed with a model JSM840A scanning electron microscope (JEOL USA, Peabody, Mass.) operating at 10 kV in the secondary electron imaging mode and coupled to an Imix-1 digital image workstation (Princeton Gamma-tech, Princeton, N.J.). Images were made at 250× and 2500×. Image width at 250× was 460 micrometers and image width at 2500× was 46 micrometers.

Detection Of 18-MEA (Saponification Of Model Fatty Acid Esters, Characterization By Thin Layer Chromatograpy (TLC) and High Performance Liquid Chromatography/Mass Spectrometry (EI-MS)): Pretreatment and treatment baths were analyzed for fatty acid content, specifically for 18-methyleicosanoic acid (18-MEA) removed from wool following a procedure developed for the analysis of model 18-MEA methyl ester (Ultra Scientific, N. Kingston, R.I.). The model fatty acid ester was saponified by 6M sodium hydroxide at 40° C.–50° C. for 4.5 h. After acidifying with 37% HCl diluted 2:8 (v/v), the solution was allowed to stand for 30 minutes before spotting on TLC plates.

Two types of TLC plates were used: Whatman (Catalog No. 4805-720, silica gel, 60 Å, 10×20 cm) and AnalTech (Catalog No. 11511, silica gel, 250 micron, 20×20 cm). They were prepared by washing in a 2:1 chloroform:methanol mixture and drying at 120° C. overnight before placing them in a dessicator. A TLC reference standard for lipids, composed of cholesterol, cholesteryl oleate, triolein, oleic acid, and methyl oleate (Nu-Chek Prep, Inc., Elysian, Minn., No. 18-4A) was diluted to concentrations of 5 mg/mL with dichloromethane. The development solvent was a mixture of hexane: diethyl ether: acetic acid (80:20:1). Visualization of the TLC plates was done by spraying with 10% sulfuric acid in methanol, drying and then charring on a hot plate. Comparison of Rf value was made to the 18-4A standard mixture that had been developed in parallel.

For analysis by EI/MS, certain sections of the silica spots were scraped off the AnalTech TLC plates and transferred to a 50 mL Erlenmeyer flask for extraction with 25 mL dichloromethane five times. After filtration and evaporation, the isolated fatty acid was recovered in dichloromethane that was further evaporated using a stream of dry nitrogen.

Fourier Transform Infrared Spectroscopy (FTIR): All measurements were made on a Nicolet Magna System 560 spectrometer by transmission IR using CaF2 disks to sandwich the sample for placement in the IR beam. The instrument was equipped with a mercury cadmium telluride detector (MCT/A) and KBr beam splitter. IR spectra were collected with mirror velocity of 0.6329 and iris aperture 15.00. The CaF2 absorption window was 4000 to 1000 $cm^{-1}$. Extracts of the hydrolyzed 18-MEA pretreatment and treatment baths were solvated with one drop of methylene chloride, and placed on a CaF2 crystal. After complete evaporation of the methylene chloride under a stream of nitrogen, the second CaF2 crystal was positioned over the first one. Data collections were made with 64 scans for sample and background with gain of 1.0 for sample and background with a collection of 3,112 data points.

EI-MS: The lipid extracts were dissolved in dichloromethane to attain a 1 mg/mL concentration. The extracted lipidic portion was separated into its components and analyzed by high performance liquid chromatography with electron impact mass spectrometry detection (EI-MS) using a Waters Integrity System (Waters Co, Milford, Mass.) consisting of a Waters 2690 Separation Module connected in series to a Waters Thermabeam Mass Detector. Sample separation was achieved with a Waters Symmetry C83.5 μm column (2 mm×150 mm) with a gradient elution as follows: water 40%-acetonitrile (formic acid 0.1%) 60% held for 5 min; to a final composition with a linear gradient of acetonitrile (formic acid 0.1%) 100% at 30 min, held for 15 min and a flow rate of 0.25 mL/min. The EI-MS detector was set to scan in the mass range of m/z 50–600 at 1 scan per second, 70 eV ionization energy. Ionization source temperature was 200° C. Nebulizer temperature was 63° C. and expansion region temperature was 75° C. Lipidic components were identified preliminarily by matching the spectrum of the separated components against the Wiley/NIST library. We made positive identification of 18-MEA from 18-MEA ester (Ultra Scientific, RI) that we had saponified and acidified and from 18-MEA that we recovered from the treatment baths with reference to the spectra of available reference standards.

Property Measurements:

Moisture Regain And Weight Loss (%): Both untreated and treated wool fabrics were brought to the bone-dry state by heating in a 105° C. oven for 4 h after which they were weighed and placed in a conditioning room of relative humidity 51% and 71° F. for 24 h. Their conditioned weights were recorded and moisture regain was determined from Equation 1:

$$\%\ \text{Moisture Regain}=100\times(C-D)/D \quad (1)$$

where, "C" is conditioned weight and "D" is dry weight.

Difference in Regain was calculated according to Equation 2:

$$\Delta\text{Regain}\ (\%)=100\times(Rb-Ra)/Rb \quad (2)$$

where Rb is Moisture Regain (%) before treatment and Ra is Moisture Regain (%) after treatment.

Weight Loss was calculated according to Equation 3:

$$\text{Weight Loss}\ (\%)=100\times(Db-Da)/Db \quad (3)$$

where Db and Da are the dry weight before and after treatment respectively.

Fabric Thickness: Fabric Thickness was measured on a Randall & Stickney meter, the measurement was carried out at five different areas and an average of five positions was taken as their final thickness (mm). The thickness difference (%) was calculated according to Equation 4:

$$\Delta\text{Thickness}\ (\%)=100\times(Tb-Ta)/Tb \quad (4)$$

where Tb is Thickness (average) before treatment and Ta is Thickness (average) after treatment.

Dimension Stability and Shrinkage (%): All samples were oven-dried (105° C.) for 4 h and subsequently conditioned overnight at 71° F. and 51% RH before measuring the fabric warp and weft dimensions. In the conditioned environment, yarns were withdrawn 4.0 cm from each edge of 10"×11" (10 gram) fabric samples to mark a rectangular area for measurement. Dimension stability % was calculated according to Equation 5:

$$\text{Area Shrinkage}\ (\%)=100\times(Ab-Aa)/Ab \quad (5)$$

where Ab and Aa are the area of sample before and after treatment, respectively.

Dimensional stability tests were conducted according to AATCC Test Method 135-1992, Dimensional Changes in Automatic Home Laundering of Woven and Knit Fabrics, Alternative Washing and Drying Conditions. Polyester double knit fabrics, 10 gram pieces, were added to the washing machine to bring the load to 3 pounds. A Kenmore washing machine was used with Woolite® fabric wash. A delicate wash (Permanent Press) cycle was used with water level set to high; warm water (35° C.) was used for both wash and rinse. The pH of the bath water was 7.63 and the wash cycle was programmed for 30 minutes. Shrinkage was determined after 5 machine wash/air-dry cycles. After the fifth wash/dry, the samples were placed in a 105° C. oven for 4 h. These samples were conditioned overnight at 71° F. and 51% RH. The dimensions on the fabric in the warp and weft directions were recorded and relative shrinkage (%) was calculated according to Equation 6:

$$\text{Relative Area Shrinkage}\ (\%)=100\times(Aa-Aw)/Aa \quad (6)$$

where Area Shrinkage (%) is the relative area shrinkage during the washing process, Aa and Aw are the area of sample after treatment and after washing, respectively. The overall shrinkages were based on Equation 7:

$$\text{Overall Area Shrinkage}\ (\%)=100\times(Ab-Aw)/Ab \quad (7)$$

where Area Shrinkage (%) is the overall area shrinkage and Ab and Aw are areas before treatment and after the washing process, respectively. Initial and overall shrinkages are important in mill processing. Relative shrinkage (%) is important for textile refurbishment by the consumer.

Whiteness and Yellowness Indices: The whiteness and yellowness indices of the fabric samples were measured using the color-insights® QC Manager system (BYK-Gardner, Inc., Silver Spring, Md.) according to ASTM E313, "Indexes of Whiteness and Yellowness of Near-White, Opaque Materials." The indices were recorded before and after treatment. The whiteness difference (%) and yellowness difference (%) were calculated according to Equations 8 and 9:

$$\Delta\text{Whiteness, }(\%)=100\times(WIa-WIb)/WIb \quad (8)$$

$$\Delta\text{Yellowness, }(\%)=100\times(YIa-YIb)/YIb \quad (9)$$

where WIa and WIb are the whiteness indices of the sample after and before treatment, respectively, and YIa and YIb are the yellowness indices of the samples after and before treatments, respectively. A positive value for ΔWhiteness (%) indicates that the whiteness increased after treatment and a negative value for ΔYellowness (%) indicates that yellowness decreased after treatment.

Tensile Strength, Elongation And Energy At Break, And Young's Modulus: Tensile strength, elongation and energy at break, and Young's modulus were measured according to ASTM D1682-64, Breaking Load and Elongation of Textile Fabrics, Method 17.1, Raveled Strip, on an Instron Model 1122 Analyzer using a 50-pound load capacity, 2.54 cm gauge length, and crosshead speed moving at 300 mm/sec. Force to break was normalized to the number of yarns within the width and their weight. Strain at break (%) was calculated according to Equation 10:

$$\text{Elongation, }\%=100\times L/L_o \quad (10)$$

where L is the original length of the test specimen, 2.54 cm, and L is the difference in this length minus the length of the specimen stretched to the breaking point. Strength in kg was recorded after normalization to the number of yarns in the one-inch test strip.

Results And Discussion:

I. $NaOH/H_2O_2$, GA, DD, Triton X-100 Followed By Enzyme:

The results of physical testing after pretreatment with $NaOH/H_2O_2$, GA, DD, and Triton X-100 followed by treatment with enzyme according to Table I are shown in Table II.

The relative importance of the various factors is shown in Table III.

From Table III, enzyme (Factor X7) was the most important factor in weight loss, strength loss, loss in fabric thickness, and fabric whiteness. $H_2O_2$ (Factor X6) was the most important factor for controlling shrinkage, and enzyme was the second contributing factor to controlling shrinkage and fabric whiteness. NaOH (Factor X1) was the primary contributing factor causing fabric shrinkage.

Without being bound by theory, it is plausible that specificity for the wool substrate is through the enzyme's serine hydroxyl active sites, which in basic medium can form a negatively charged transition-state acting as an acyl-intermediate. By subsequent deacylation, the acyl-enzyme intermediate is hydrolyzed by a water molecule to restore the serine hydroxyl of the enzyme. This proceeds with concomitant hydrolysis of the wool peptide linkage (FIG. 1).

Under the conditions of experiment 8 in Table I, we activated the enzyme in alkali medium after a pretreatment with $NaOH/H_2O_2$ had made the wool more accessible to the enzyme. It is interesting to note that both initial and relative shrinkages were controlled by treatment according to experiment 8, as shown in Table IV.

Experiment 8 with 3 g/L $NaOH/H_2O_2$, GA, DD, and Triton X-100 followed by enzyme, treatment showed the lowest initial, relative, and overall shrinkages whereas experiments 3 to 6 without $H_2O_2$ gave the highest shrinkage results. The scanning electron micrographs comparing wool fibers treated according to the conditions of experiment 1 to those of experiment 8 show the dramatic effects of $H_2O_2$ and enzyme on scale smoothing to alleviate shrinkage.

Figure 2:
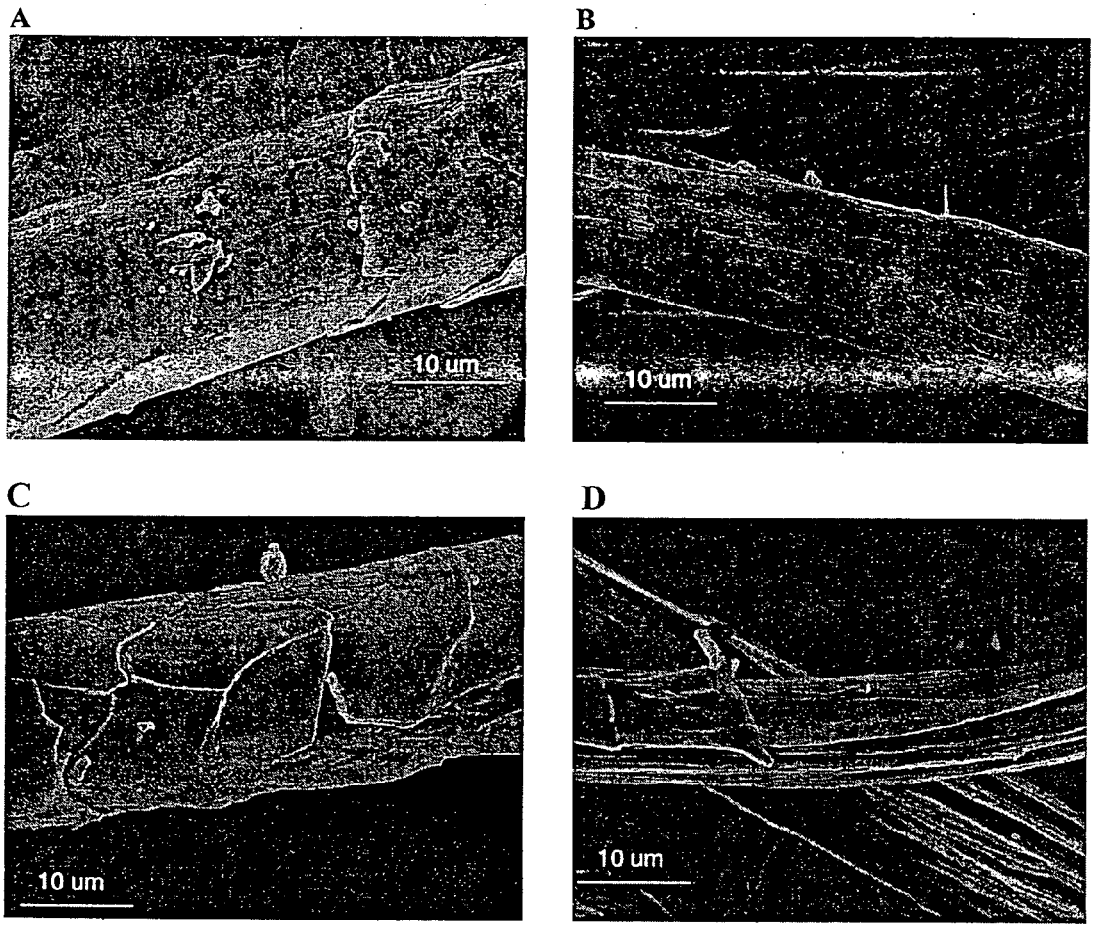
FIG. 2 shows scanning electron micrographs of treated wool fibers ((a)—fibers treated according to experiment 1 below; (b, c, d)—fibers treated according to experiment 8 below)

The view that formation of oxidized groups by $NaOH/H_2O_2$, DD, GA, and Triton X-100 contributes to smoothing of the cuticle layer is supported by the scanning electron micrographs in FIG. 2(*a*) representing experiment 1; compare the effects of this treatment to the effects of those that include 2% enzyme in FIGS. 2 (*b–d*), all representing experiment 8. There is dramatic evidence of scale alteration and damage to the inner cortex of the wool fiber with concomitant loss in mechanical properties shown in FIGS. 4 (*a–c*).

Figure 3:
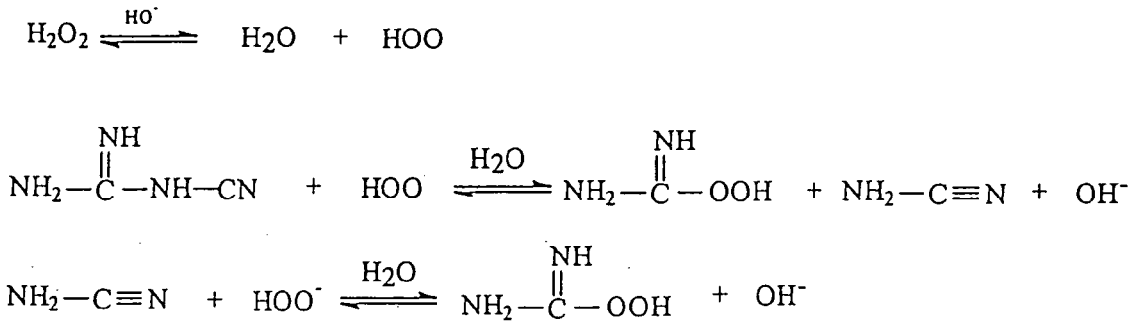
FIG. 3 shows reaction pathway for $H_2O_2$ activation by dicyandiamide at room temperature.

Furthermore, note from Table IV that in enzyme treatments following pretreatments with $NaOH/H_2O_2$ without GA and DD (experiment 2) shrinkage is low but the addition of GA and DD (experiment 8) results in complete shrinkage control. Without being bound by theory, we hypothesize that DD acted as a hydrogen peroxide activator to enhance the oxidation ability of hydrogen peroxide at room temperature, and we propose the reaction scheme in FIG. 3 whereby the increased nucleophilicity of the —NH group in the peroxy DD species causes this peroxide to have greater oxidizing potential than $H_2O_2$.

Figure 4A:
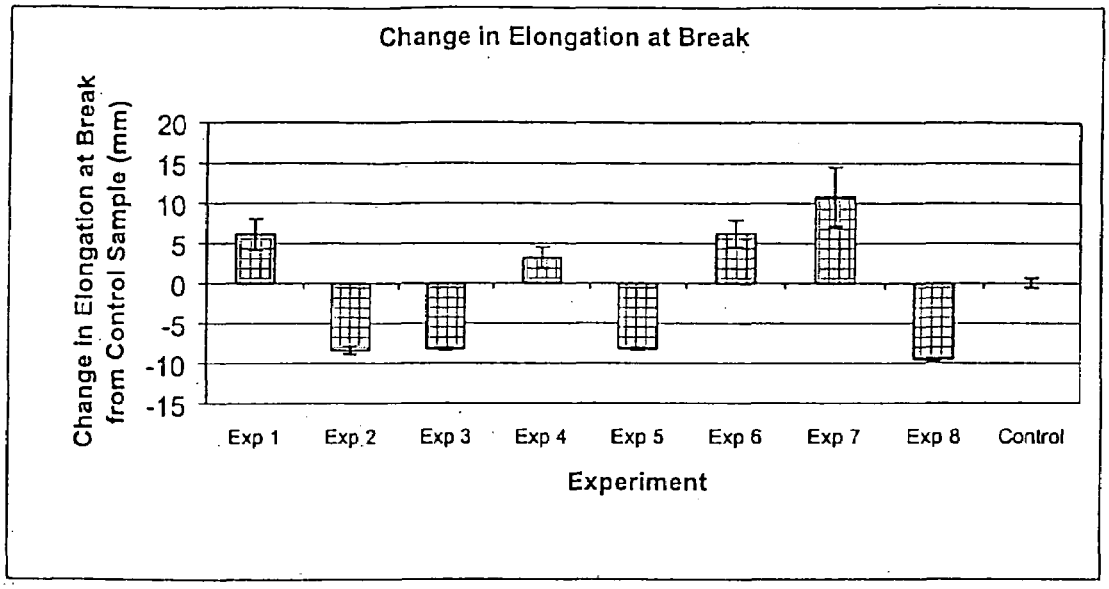
FIG. 4 shows effects of NaOH/$H_2O_2$, gluconic acid, dicyandiamide, Triton X-100 pretreatments (#1, #4, #6, and #7 in Table I) and this pretreatment with sequential enzyme treatments (#2, #3, #5, and #8 in Table I) on mechanical properties: (a) change in elongation at break; (b) modulus; and © energy to break.
Figure 4B:
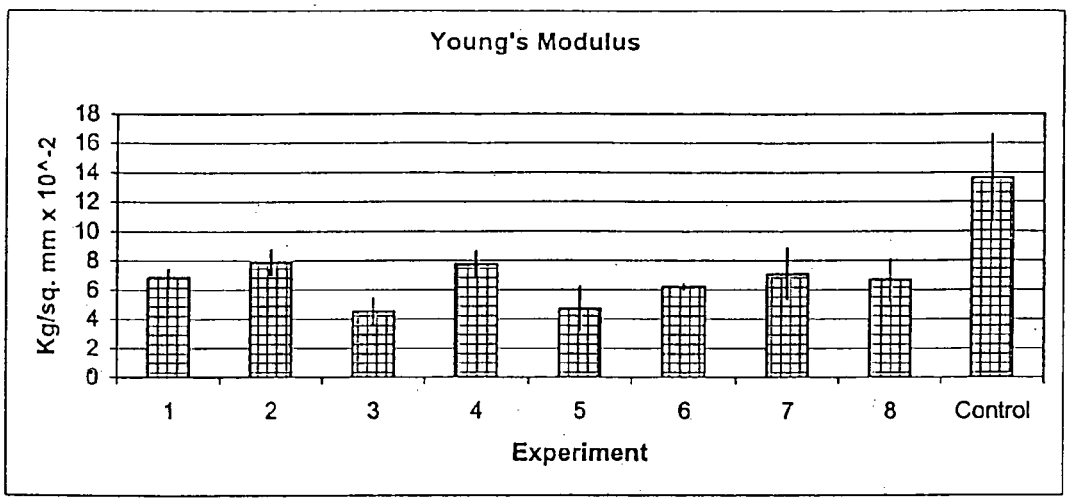
Figure 4C:
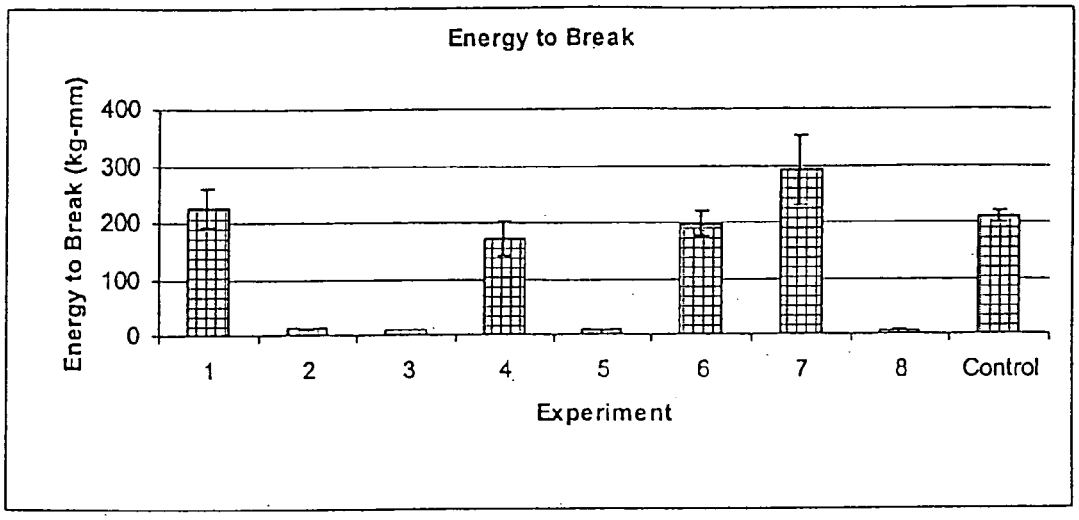

The mechanical properties of the wool fabrics treated according to experiments 1–8 are shown in FIGS. 4 (*a–c*).

It is apparent that reactions with enzyme in experiments 2, 3, 5, and 8 produced not only appreciable fabric strength loss but loss in elongation and energy at break while all treatments resulted in loss in modulus so that the fabrics became more pliable and less rigid. Our deduction that in the enzyme systems the cortical cells of the wool fiber had been attacked, thereby causing loss in mechanical properties, was supported by the scanning electron micrographs in FIG. 2 (*d*).

II. $NAOH/H_2O_2$, GA, DD, TRITON X-114 without enzyme:

Experiment 8 showed stripping and partial removal of the cuticle layer of wool resulting in damage to the inner cortical cells. Removal of wool's lipid layer assisted in the penetration of chemicals and enzyme into the interior of the fiber. We attributed this in part to the additive, Triton X-100, a nonionic surfactant commonly used in dyeing wool, which shortened the wetting time of wool and assisted in the penetration of the enzyme. By replacing Triton X-100 with Triton X-114 (the lower cloud point of Triton X-114 was responsible for the formation of a cloudy solution) we proposed to protect the fiber from enzyme penetration to assure that all reactivity would take place on the fiber surface. We tested this theory by performing individual pretreatments analogous to experiments 1 and 8 using Triton X-114 according to Table V.

Figure 5:
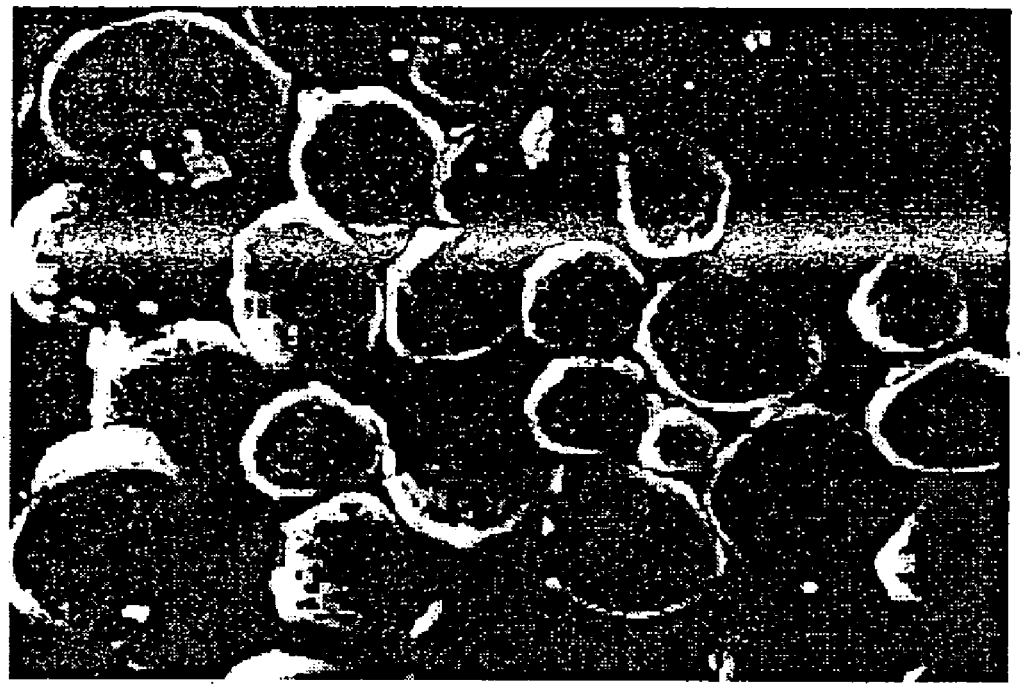
FIG. 5 shows confocal microscopic image of cross-sectioned wool fibers, # 79 (Table VI)

Cross-sections of stained fibers from sample #79 were prepared with Rhodamine B solution for confocal fluorescence imaging. In FIG. 5, the confocal micrograph of the fibers show evidence of negative charge on the fiber surface because of the attraction of this cationic dye.

Figure 6:
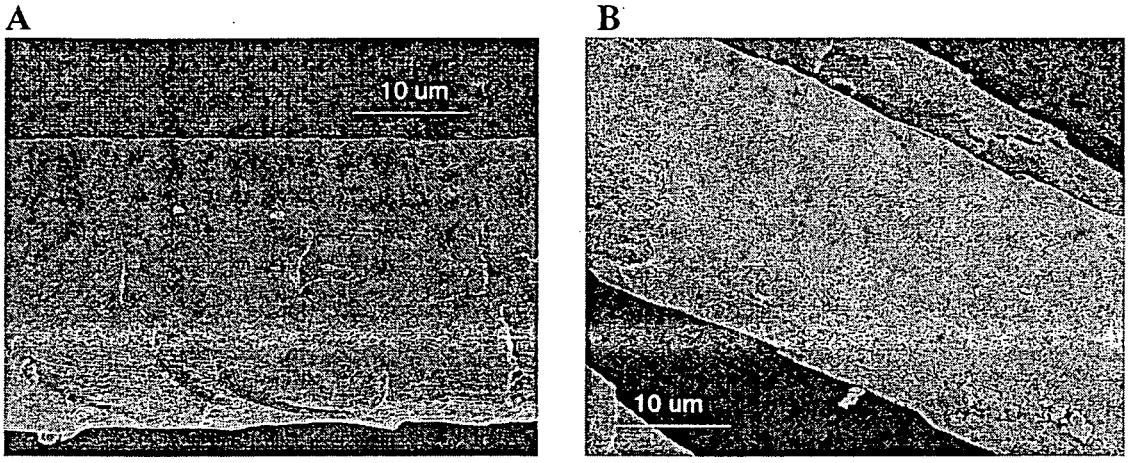
FIG. 6 shows scanning electron micrographs of fibers treated with NaOH/$H_2O_2$, gluconic acid, dicyandiamide, and Triton X-114: (a) 1 g/L NaOH (# 61 (below)); (b) 3 g/L NaOH (#79 (below))

Scanning electron micrographs of fibers from fabrics treated with 1 g/L NaOH (#61) showed partial smoothing of the cuticular surface. Fibers from fabrics treated with 3 g/L NaOH (#79) showed complete smoothing (FIG. 6).

Neither treatment at either concentration of NaOH resulted in loss of fabric strength (Table VI). Fabrics treated at the higher base concentration (#79) exhibited low relative shrinkage.

Figure 7A:
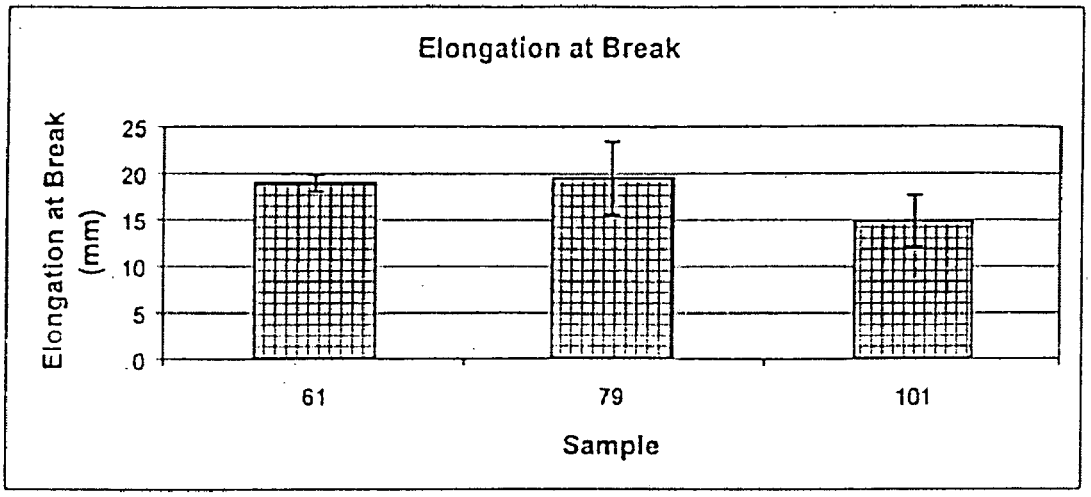
FIG. 7 shows effects of NaOH/$H_2O_2$, gluconic acid, dicyandiamide, Triton X-114 treatments on mechanical properties: (a) change in elongation at break; (b) modulus; and (© energy to break.
Figure 7B:
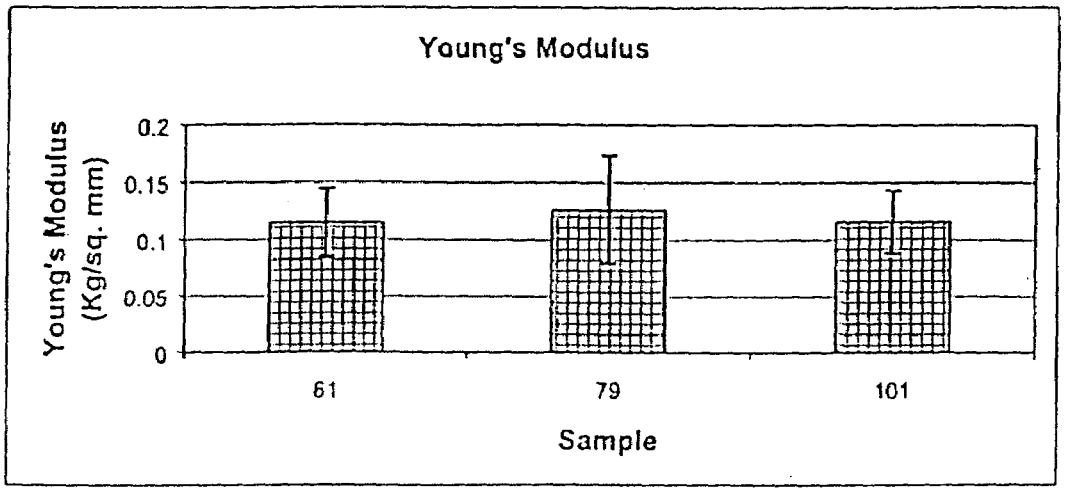
Figure 7C:
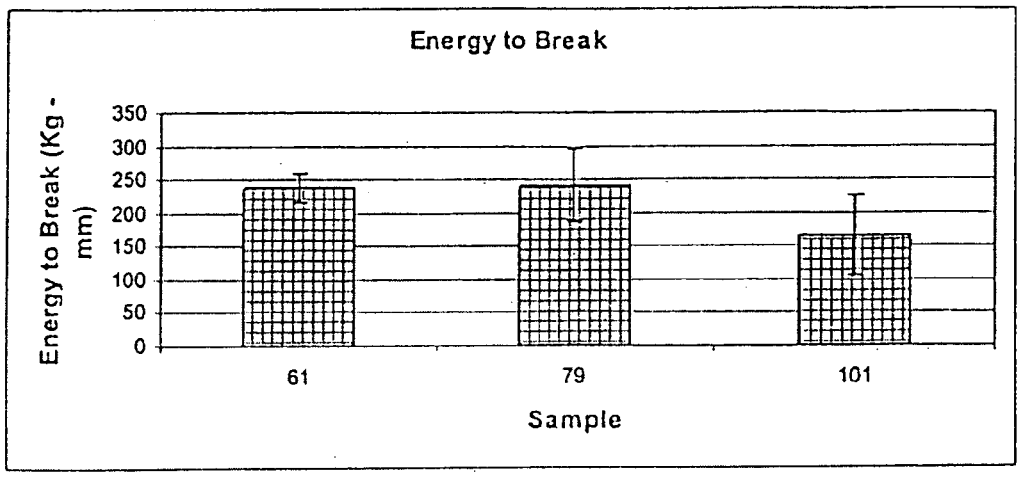

Changes in mechanical properties of the fabrics treated according to Table V are shown in FIG. 7.

It is clear that in these NaOH/$H_2O_2$, GA, DD, Triton X-114 systems the presence of enzyme was not necessary for shrinkage control and mechanical properties were not affected negatively.

III. NaOH/$H_2O_2$, GA, DD, Triton X-114 Followed By PAA (polyacrylamide)/Enzyme:

Another approach to including protease in a shrinkage-resistant process was to incorporate PAA polymer which has affinity for the enzyme so that its association with the enzyme would limit enzyme activity to the fiber surface.

Figure 8:
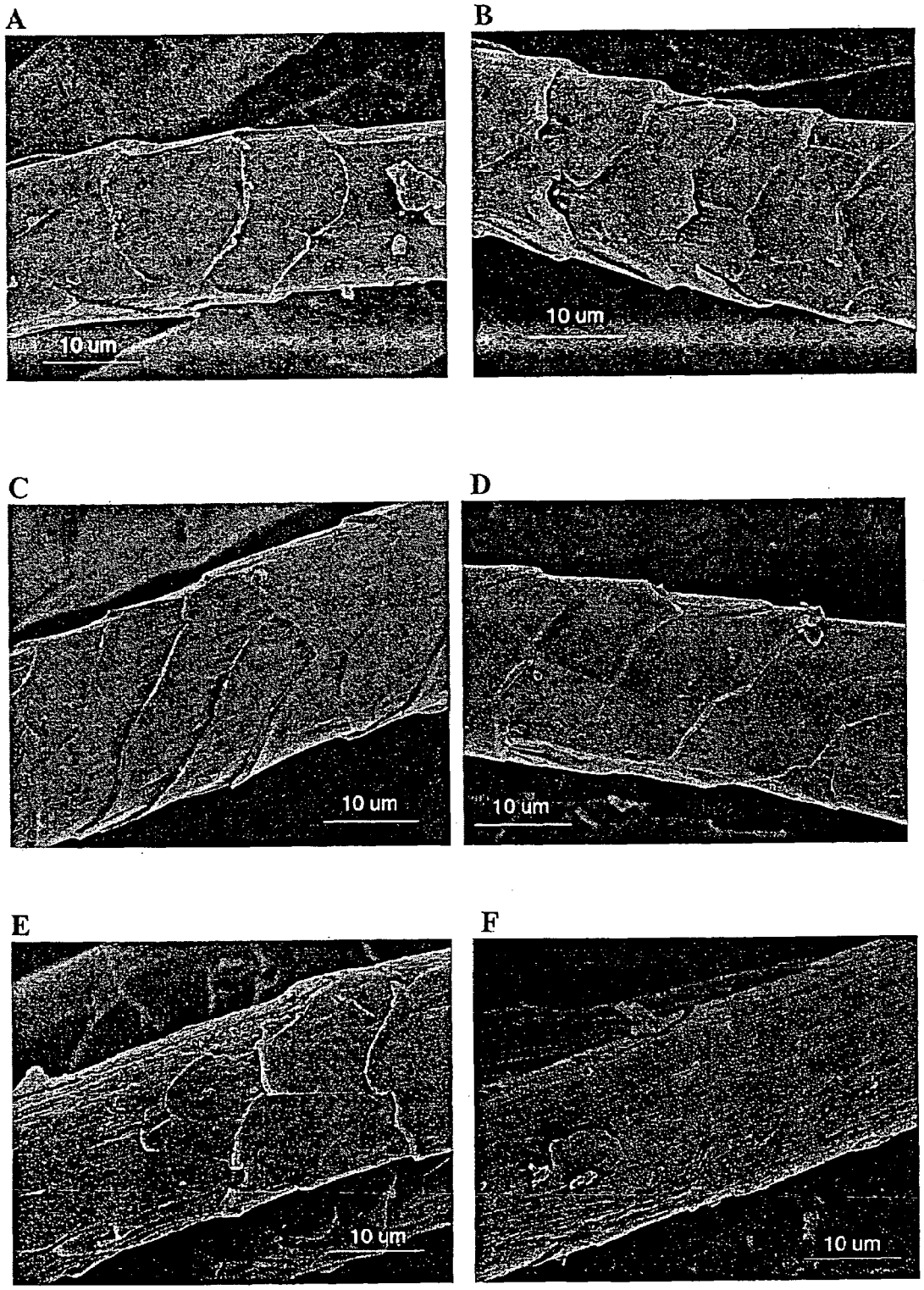
FIG. 8 shows scanning electron micrographs of PAA/Triton X-114 treatments with enzyme: (a) one-step, no protease; (b) one-step, 0.5% owf protease; © one-step, 1.0% owf enzyme; (d) one-step, 1.5% protease; (e) two-step, #57 (Table VII below); (g) two-step, #99 (Table VII below)
Figure 9A:
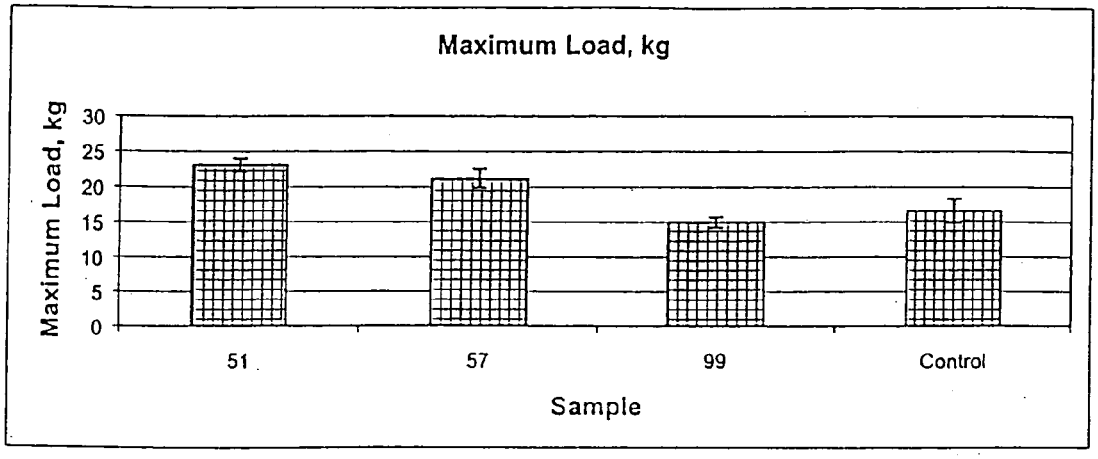
FIG. 9 shows effects of NaOH/$H_2O_2$, gluconic acid, dicyandiamide, Triton X-114 pretreatments with sequential PAA/enzyme, Triton X-114 treatment on mechanical properties: (a) breaking strength; (b) elongation at break; © energy to break; and (d) modulus.
Figure 9B:
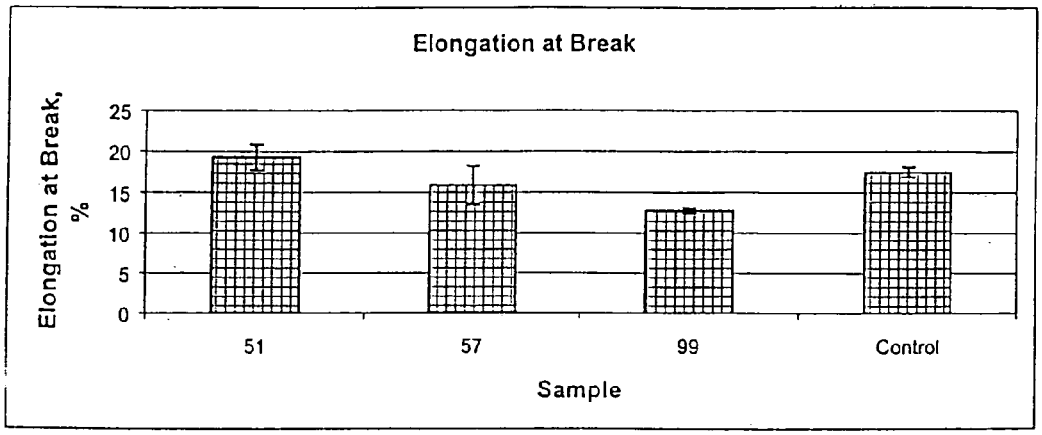
Figure 9C:
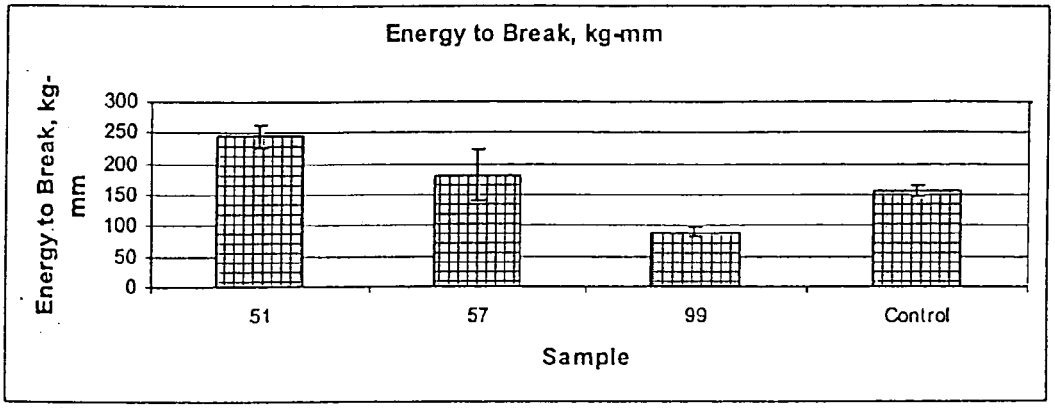
Figure 9D:
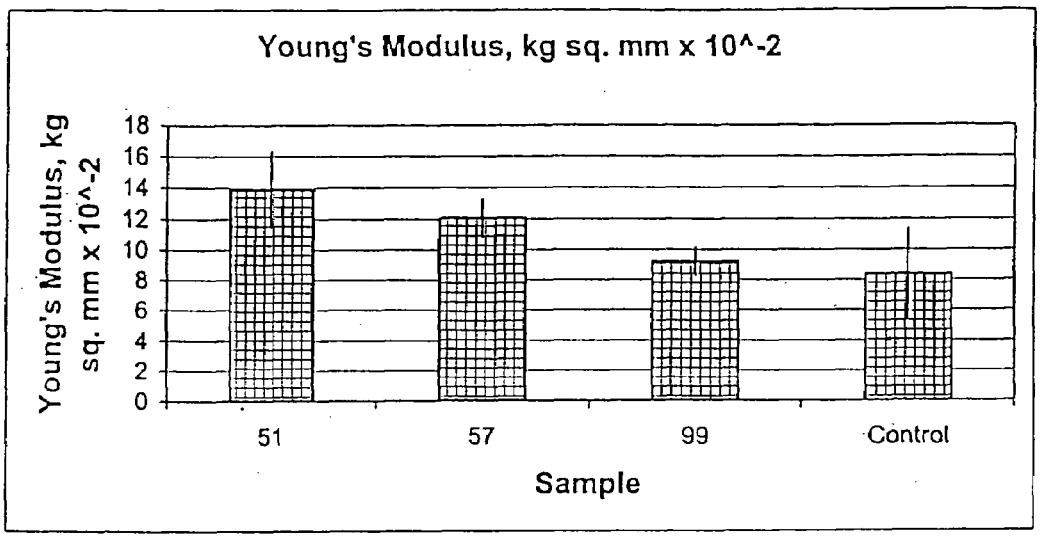

Although the specific data for another system, one-step 2% of PAA treatments with enzyme at 45° C. for 40 minutes in one bath containing 1 g/L Triton X-114 are not shown, the scanning electron micrographs are shown in FIGS. 8 (*a–d*). Note that there is only slight scale alteration. The lowest relative shrinkage was 8.3% and there was no loss in fabric whiteness or strength.

To improve the PAA/Triton X-114 enzymatic system for greater shrinkage control, a two-step process was adopted. Wool fabric was pretreated with NaOH/$H_2O_2$, GA, DD, Triton X-114 according to #61, shown in Table VII, followed by treatment with PAA/Triton X-114 and enzyme according to #51, #57, and #99, shown in Table VII. Note that in #99, $Na_2SO_3$ was added to the PAA/Triton X-114 enzyme bath. The scanning electron micrographs are shown in FIG. 8 (*e* and *f*).

The results of property testing of fabrics treated according to the procedures in Table VII are shown in Table VIII and mechanical properties are shown in FIG. 9.

Figure 10:
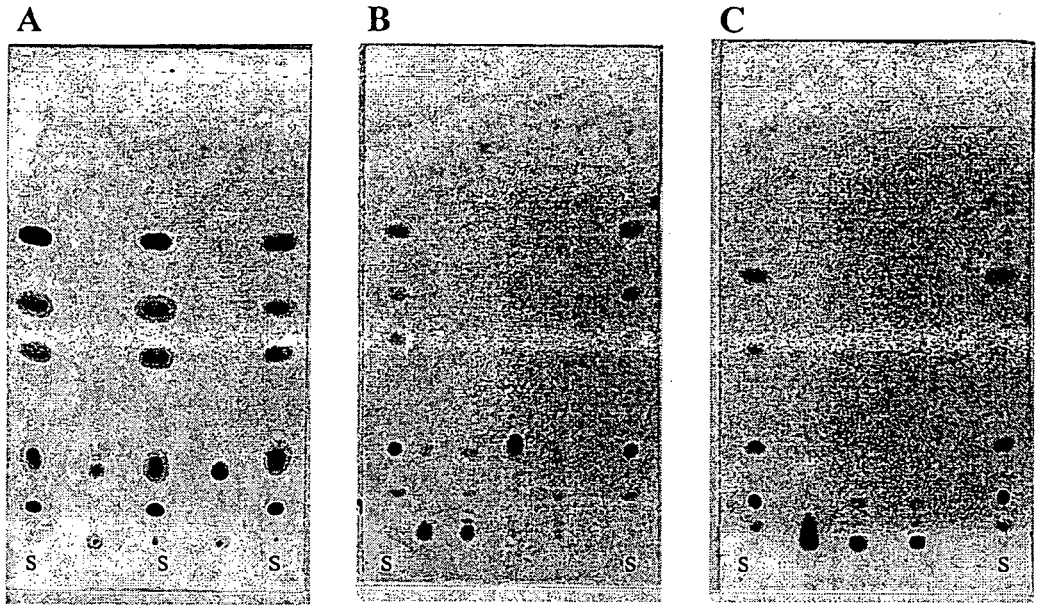
FIG. 10 shows TLC plates showing lipid 18-4A standards (s) in progression from polar to nonpolar as follows: cholesterol (c, standard for sterol), oleic acid (oa, standard for free fatty acid), methyl oleate (mo), triolein (to), and cholesteryl oleate (co): (a) saponified 18-MEA methyl ester, duplicate columns 2 and 4 from the left, each show a spot in the fatty acid region of the 18-4A standard mixture; (b) pretreatment spent bath (column 2) and enzyme spent bath (column 3) are similar and show both sterol and fatty acid and column 3 is the first portion on 18-MEA recovery from saponification and acidification of 18-MEA methyl ester; © pretreatment bath before use (column 2 from the left) shows no fatty acid whereas in column 3, the TLC of the spent pretreatment bath shows the presence of fatty acid, as does the spent enzyme bath represented by column 4; developing solvent was 80:20:1 hexane: diethyl ether: acetic acid and visualization was by 10% sulfuric acid in methanol and charring.

Structural Changes in Wool:

The results of TLC analyses to monitor the saponification of 18-MEA methyl ester, the presence of 18-MEA in the pretreatment bath (sample #61), and its presence in the spent treatment bath (sample #57) are shown in FIG. 10.

Figure 11:
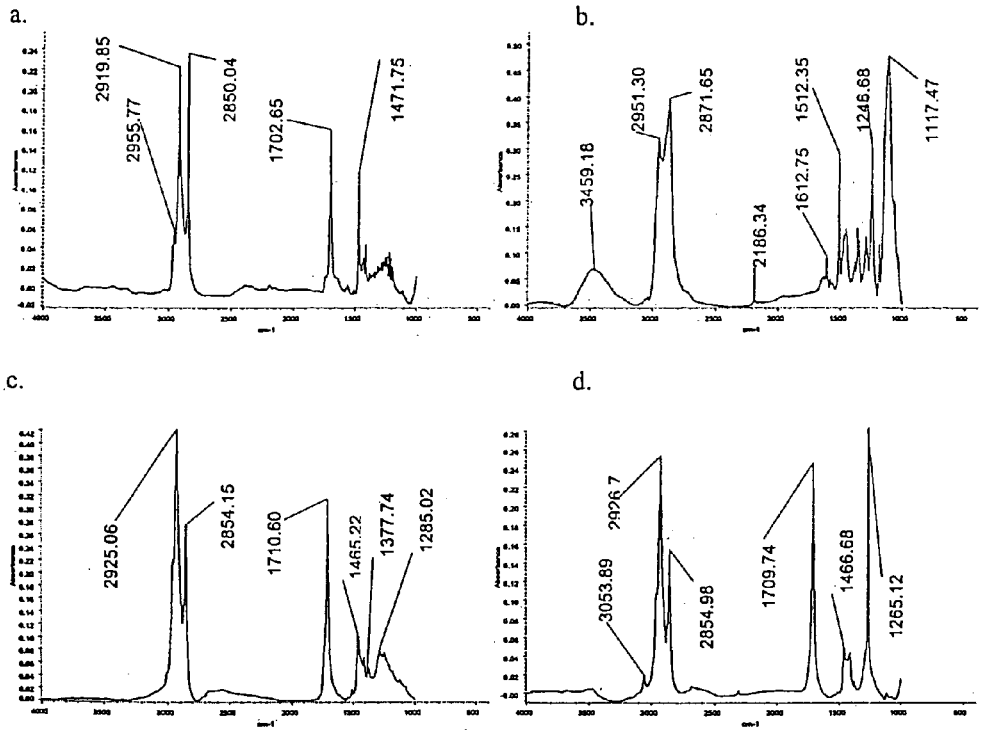
FIG. 11 shows IR transmission spectra to document the presence of 18-MEA in solution: (a) 18-MEA from hydrolyzed 18-MEA methyl ester purchased from Ultra Scientific, RI; (b) pretreatment bath without wool and without enzyme; © pretreatment bath after pretreatment of wool according to experiment #61, product isolated by TLC for identification of fatty acid; (d) enzyme spent treatment bath after treatment according to experiment #57 (Table VII); product isolated by TLC for identification of FFA.

The IR spectra of 18-MEA in the pretreatment and pretreatment spent baths are shown in FIG. 11.

The spectrum of 18-MEA in FIG. 11(*a*) shows a broad —OH stretching frequency of the acid in the absorption region 3000–2800 $cm^{-1}$. Dimerization through hydrogen bonding of the fatty acid explains the considerable OH shift from —OH stretching vibrations of carboxylic acids between 2700–2500 $cm^{-1}$ which is normally at 3560–3500 $cm^{-1}$. The strong carbonyl absorption at 1702 $cm^{-1}$ is associated with the dimeric carboxyl group of the fatty acid. The carbonyl absorption of saturated fatty acids ($C_{14}$–$C_{21}$) in solution is at 1712+/−6 $cm^{-1}$ whereas in solution they are a few $cm^{-1}$ lower. The 1471 $cm^{-1}$ absorption band and the absorbances in the 1350–1180 $cm^{-1}$ region have been attributed to the methylene vibrations of fatty acids. This region is known for fatty acid band progression whereby as the length of the carbon chain increases in a fatty acid, the number of bands increases; for example, $C_{21}$ was reported to show nine such bands. In FIG. 11 (*b*) the spectrum of the pretreatment bath #61 before use shows the broad 3459 $cm^{-1}$ bands and the carboxylate bands in the 1610–1550 $cm^{-1}$ region for GA. The spectrum also shows a minor cyanide peak at 2186 $cm^{-1}$ from DD and an —OH overtone band at 1117 $cm^{-1}$. The spectra of the fatty acid region from pretreatment #61 as isolated by TLC and the FFA region pretreatment (#57) bath, handled similarly, show absorption bands characteristic of 18-MEA in (a), thus providing evidence that 18-MEA was removed by alkaline peroxide with GA and DD additives during pretreatment. Without being bound by theory, we speculate that covalently bonded 18-MEA was made susceptible by this pretreatment to subsequent removal of additional 18-MEA during treatment with protease.

Figure 12:
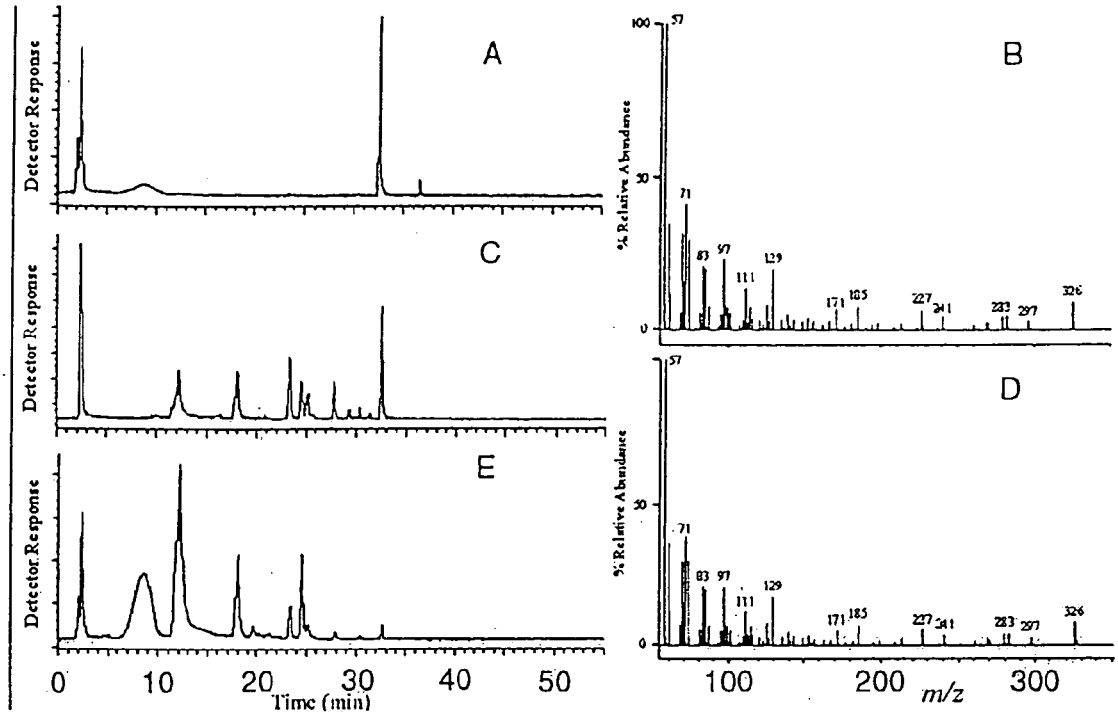
FIG. 12 shows EI-MS chromatogram and spectra documenting the presence of 18-MEA: (A and B) EI and MS, respectively, of model 18-MEA after saponification of the methyl ester; © and D) EI and MS, respectively, of 18-MEA from residual spent pretreatment bath (experiment #61 (Table VII)); (E) EI chromatogram of 18-MEA from residual protease treatment bath (experiment #57 (Table VII))

The EI-MS spectrum of commercial 18-MEA methyl ester, which was saponified with NaOH to 18-MEA, is found in FIGS. 12 (A and B). FIG. 12(A) shows EI chromatogram of an authentic 18-MEA standard after hydrolysis to the corresponding fatty acid elutes at 32.5 minutes, consistent with a $C_{18}$ fatty acid in the Wiley/NIST library in the MS in FIG. 12(B). In FIG. 12 © and D), spot migration patterns from TLC plate, FIG. 10 © (extracted from columns 3 and 4) represent pretreatment (experiment #61) and treatment (experiment # 57) baths containing 18-MEA as shown by EI chromatograms in FIG. 12 © and E). Note that the EI chromatograms © and E) that similarly show a peak eluting at 32.5 minutes are in good agreement with the 18-MEA fatty acid standard 18-MEA (A).

Discussion:

We discovered effective alkaline hydrogen peroxide systems that confer shrinkage resistance when used alone or with subsequent enzyme applications. In this report, we found that $H_2O_2$ was an effective replacement for DCCA in conferring anionic charge on the surface of wool fibers, leading to the achievement of similar low levels of shrinkage. We evaluated the relative importance of the effects of NaOH, $H_2O_2$ and enzyme on shrinkage control and on the changes in physical properties of the treated wool fabrics, and found that $H_2O_2$ was the most important factor and enzyme was the second contributing factor in controlling shrinkage. NaOH was the primary contributing factor causing fabric shrinkage. Notably, enzyme was the most important factor in fabric weight loss, loss in fabric thickness, strength loss, and fabric whiteness. Without being bound by theory, we postulated that achieving negligible shrinkage by pretreating with NaOH/$H_2O_2$, DD, GA, Triton X-100 before treating with enzyme was due in part to formation of a highly reactive DD peroxide species and that the loss in mechanical properties we observed was due chiefly to exposure to the enzyme.

As a result, further investigations led to the discovery that a nonenzymatic NaOH/$H_2O_2$, GA, DD, X-114 system was effective in controlling shrinkage to 2.95% without loss in mechanical properties. In this case we postulated that without the enzyme present and with the inclusion of a low cloud-point surfactant, Triton X-114, reactivity would be limited to the fiber surface and the result would be that mechanical properties would be preserved.

We discovered that enzyme could be used without loss in structural integrity of the wool if applied with polymeric PAA that would associate with the enzyme to prevent its permeation beyond the fiber surface. After pretreatment with NaOH/$H_2O_2$, GA, DD, X-114, treatment with PAA/enzyme, Triton X-114 resulted in area shrinkage of 6% to 7% which was reduced to 1.16% by including $Na_2SO_3$ in the enzyme treatment bath.

For a better understanding of our discoveries, we investigated the structural changes in wool and found there was evidence of 18-MEA in spent peroxide baths. Furthermore, an even greater discovery was that we had found evidence of 18-MEA in the extracts of wool fabrics that had been pretreated with $NaOH/H_2O_2$, GA, DD, X-114, followed by treatment with enzyme. This led us to conclude that rendering 18-MEA labile to extraction is important for effective shrinkage control. Validation of the presence of 18-MEA was supported by TLC separations that matched the elution patterns of a standard fatty acid, oleic acid. FTIR analyses of prepared TLC fractions showed the characteristic absorption bands of fatty acids that corresponded to standard 18-MEA methyl ester that had been saponified and acidified. These samples from TLC separations were then analyzed by EI-MS to show that 18-MEA was indeed present in both spent pretreatment and treatment baths.

Two acceptable shrinkage control systems involve the following: (1) one-step nonenzymatic treatment with $NaOH/H_2O_2$, DD, GA, Triton X-114 (experiment #79) and (2) two-step enzymatic pretreatment with $NaOH/H_2O_2$, DD, GA, Triton X-114 followed by treatment with PAA/enzyme/Triton X-114 with co-addition of 2% of $Na_2SO_3$ (experiment #99).

Second Example

Materials And Methods:

Worsted wool fabrics, D-Gluconic acid, Triton X-114, Esperase®, dicyandiamide and hydrogen peroxide were the same as described above. Triethanolamine (Aldrich Chemical Company, WI) was used as buffer for enzyme treatment. Sodium hydroxide (NaOH) was obtained from Mallinckrodt Baker, Inc. (Paris, Ky.) in a lab grade.

Experimental Design: Wool fabrics, four at a time, were pretreated and treated in individual baths with liquor ratio 25:1. Pretreatment baths contained 3 g/L NaOH, 3 g/L DD, $H_2O_2$ (30%): 20 ml/L, 1 g/L potassium salt of GA and 2 g/L Triton X-114. All samples were pretreated at 30° C. for 30 minutes in an Atlas LP2 Launder-Ometer and Lab Dyeing System. After pretreatment the fabrics were rinsed in cold water and squeezed of excess water before placing them in the enzyme treatment baths. Enzyme baths, run at 45° C., were prepared according to Table IX, where the concentrations of Esperase 8.0L and sodium sulfite were based on the weight of samples (40 g). Each bath represented four 10 gram wool fabric samples in a total liquor volume of 1L (25:1 LR) for a total bath volume of 400 mL. Each bath was buffered by adding 10 mL of 1M triethanolamine solution to pH 8.6 for a bath concentration of 0.01M or 1.5 g/L triethanolamine. 1 g/L of Triton X-114 was added to each bath.

After treatment, five wash cycles were carried out using a Whirlpool® (Sears) washing machine programmed as follows: load size: large; temperature, wash/rinse warm (37° C.)/cool; extra rinse: off/off; delicates wash: total time for each circle 30 minutes. The washing liquid was 1 cup of Woolite® for each circle of a 3 pound load. The fabrics were air-dried after the 5th wash.

Statistical Design: A central composite design (CCD) is represented by the experiments described in Table I. The experiments contain an imbedded fractional factorial design with center points that allow estimation of response surface curvature. This method was applied to find the optimum conditions for minimizing shrinkage by performing the series of 20 experiments at different combinations of enzyme, and sulfite concentration and exposure time. The response surfaces for relative shrinkage, load at break, and weight loss are shown by the graphs in FIGS. 17 *a, b, c*. They illustrate the quadratic model shown in Equation 1. These graphs can be examined to determine which treatment conditions will maximize shrinkage control, while maintaining adequate breaking load and weight loss.

$$\begin{aligned}\text{Response} = {} & a + b*(Na_2SO_3, \%\ owf) + c*(\text{enzyme}, \%\ owf) + \\ & d*\text{time} + e*(Na_2SO_3, \%\ owf)* \\ & (\text{enzyme}, \%\ owf) + f*(Na_2SO_3, \%\ owf)*\text{time} + \\ & g*(\text{enzyme}, \%\ owf)*\text{time} + h* \\ & (Na_2SO_3, \%\ owf)*(Na_2SO_3, \%\ owf) + i* \\ & (\text{enzyme}, \%\ owf)*(\text{enzyme}, \%\ owf) + j*\text{time}* \\ & \text{time}.\end{aligned} \tag{1}$$

where "a" to "j" are regression coefficients obtained by least squares for the responses: relative shrinkage, breaking load, and weight loss.

Property Measurements: Dimension stability and shrinkage (%); whiteness and yellowness indices; tensile strength, elongation and energy at break, and Young's modulus (measured at 51% relative humidity and 71° F.); and scanning electron microscopy (SEM) were determined using the methods described above.

Digital Image Analysis For Capturing A Fabric's Projecting Fiber Ends: A fabric sample was positioned within an Aristo DA-10 (Aristo Grid Lamp Products, Inc., Port Washington, N.Y.) light box equipped with serpentine white lighting around the top periphery. A 35 mm camera equipped with a 40 mm extension tube and mounted onto an MTI CCD 72 B&W digital camera (HiTech Instruments, Inc., Edgemont, Pa.) was positioned one inch from the fabric for an area of view of 1½ inches. The camera assembly was mounted on a Bencher Copystand (Bencher, Inc., Pennsauken, N.J.) above the light box. A FlashBus MVPro frame grabber board (I Cube, Crofton, Md.) resided in a personal computer that had been installed with Image-Pro Plus software Version 4.5 (Media Cybernetics, Silver Spring, Md.). eight-bit gray scale images were acquired of fabric that had been folded and placed under glass so that the projecting fiber ends from the position of the fold were images. Three fold points of each fabric were captured. A "reduce" filter was applied that allowed the isolation of discrete projecting fiber ends from the edge of the folded fabric that were next counted from the "count/size" utility of the software. This procedure was repeated at two other fold points on the same fabric so that three sets of counts could be collected for each fabric. The results are depicted in FIG. 13 for the samples shown in Table I.

Figure 13:
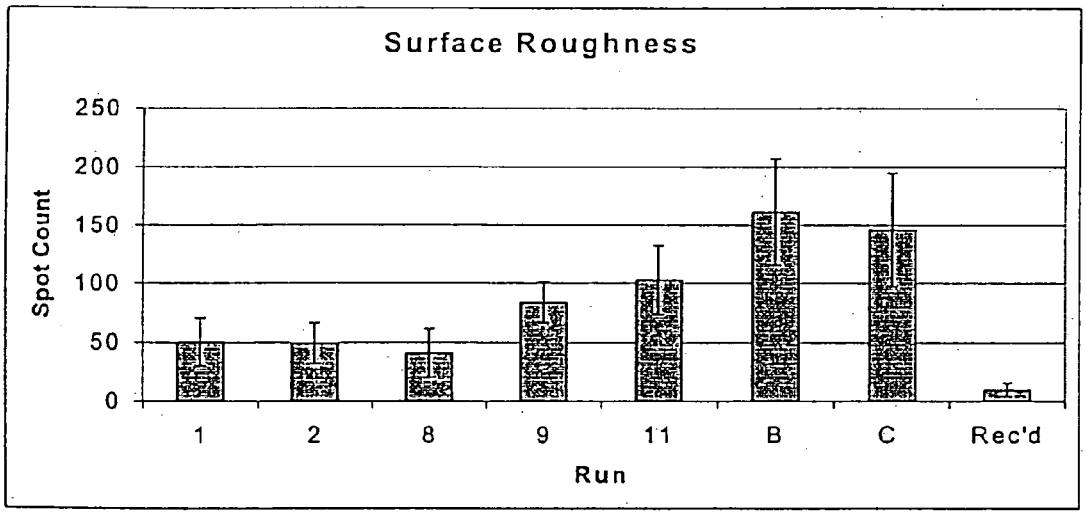
FIG. 13 shows surface roughness based on the count of projecting fiber ends above the surface of the fabric as evaluated by digital image analysis.
Figure 14:
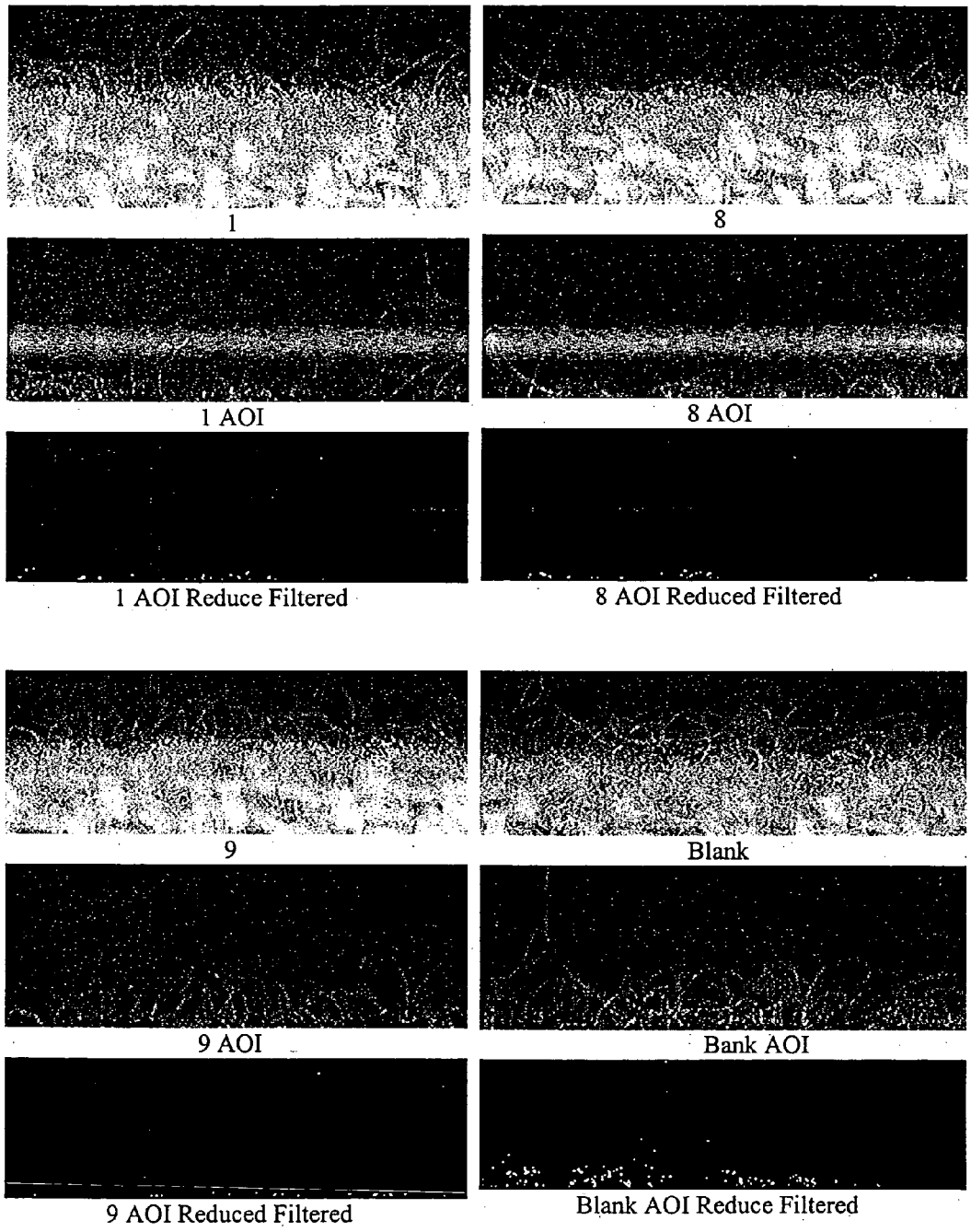
FIG. 14 shows digital images of pretreated wool fabrics corresponding to the counts shown in FIG. 1: run 1 (0.5% owf protease and 0.5% owf sodium sulfite); run 8 (1.5% owf protease and 1.5% owf sodium sulfite); run 9 (1.0% owf protease without sodium sulfite); Blank; Control.
Figure 14:
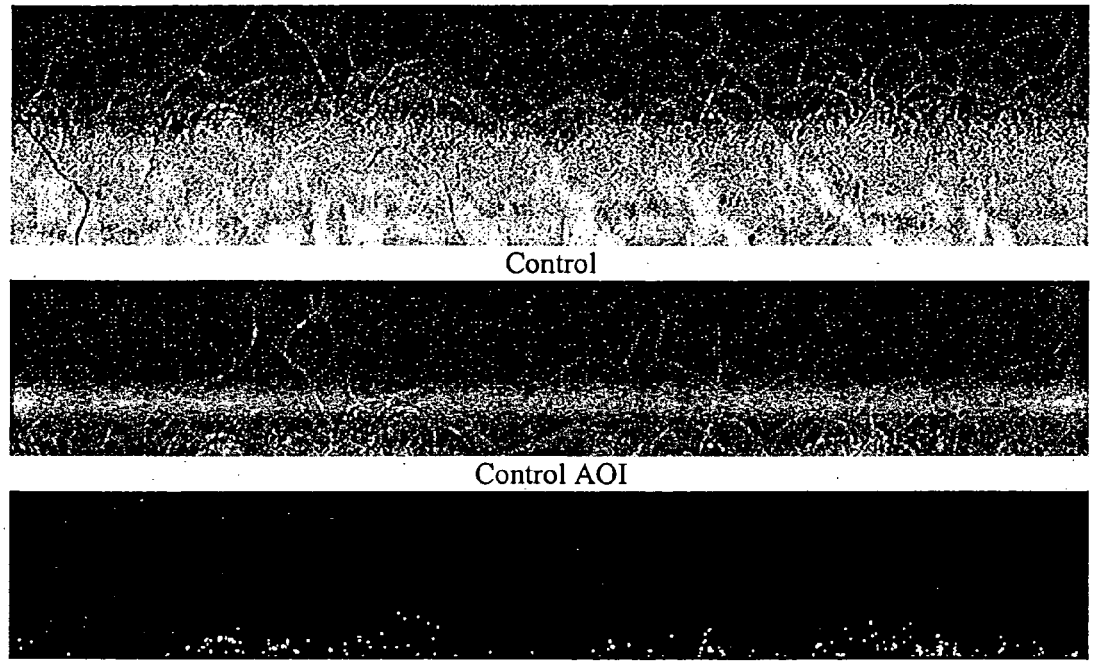

Results and Discussion:

Surface Roughness:

The surface roughness of the $H_2O_2$/GA/DD-pretreated wool fabrics treated with equivalent relatively low level of sodium sulfite and enzyme (Run 1) and high level (Run 8) and with enzyme alone (Run 9) and sulfite alone (Run 11) are compared to the blank and the control fabric as received for projecting fiber count in FIG. 13 and for visual perception of surface fuzziness as portrayed in their digital images in FIG. 14. Note the significant decrease in surface roughness of runs 1 to 8 that were treated with both enzyme and sulfite when compared to runs 9 and 11 that were treated with either enzyme or sodium sulfite alone. Note further that fabrics treated according to the conditions in runs 9 and 11 are not significantly different in surface roughness when compared to the blank samples, B, and control samples, C.

Scanning Electron Photomicrographs: The micrographs in FIGS. 15 (*a–f*) of pretreated fabrics treated according to Table I reveal that the greatest extent of scale disruption and smoothing occurred in fabrics treated with enzyme and sodium sulfite when compared to fabrics treated with either enzyme or sodium sulfite alone.

Figure 16A:
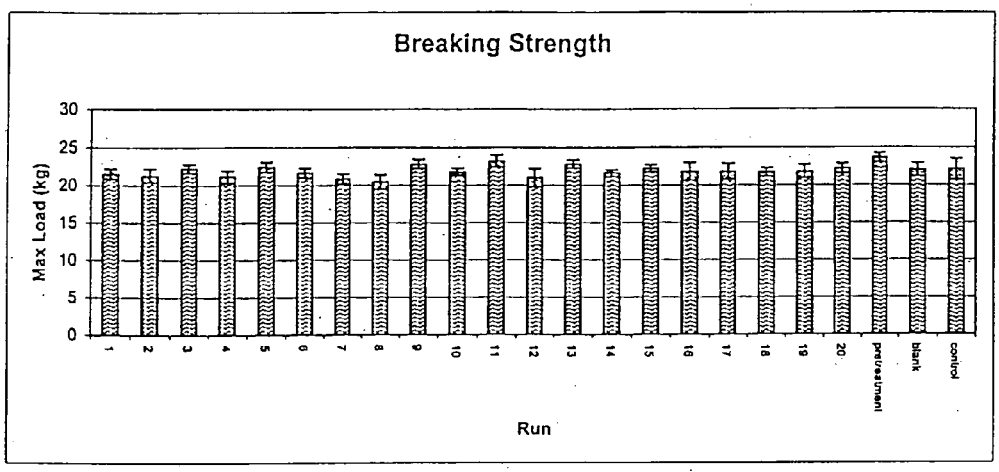
FIG. 16 shows mechanical properties of wool fabrics after pretreatment followed by treatments with enzyme and sodium sulfite: (a) breaking strength; (b) elongation at break; © Young's modulus.
Figure 16B:
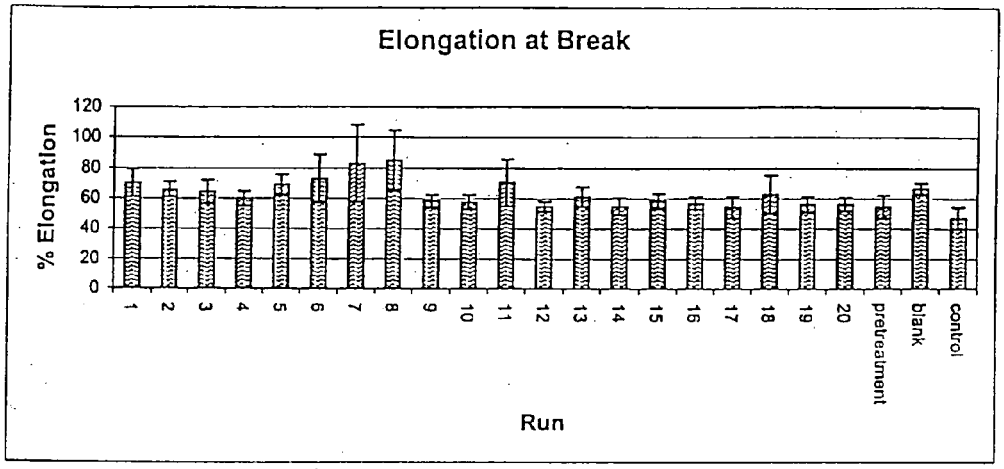
Figure 16C:
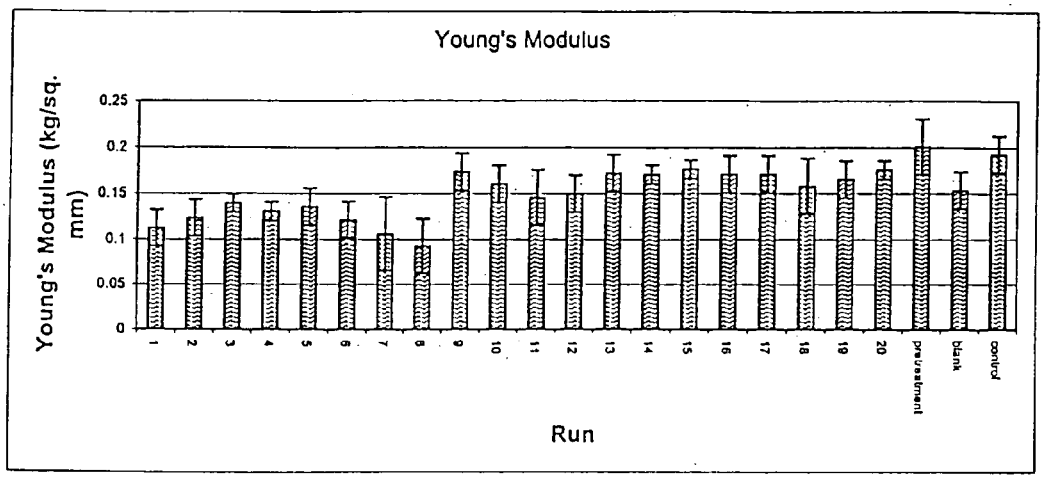

Mechanical Properties: The effects on mechanical properties after treatment with $H_2O_2$/GA/DD followed by enzyme and sodium sulfite in FIGS. 16 (*a, b*, and *c*) reveal that fabric strength and elongation remained essentially unchanged. However, fabrics from 1 to 8 that had been treated with either the same amounts of enzyme and sodium sulfite or with relatively lower amounts (0.5% owf to 1.5% owf) of each exhibited lower modulus to indicate a loss in fabric stiffness.

Figure 17A:
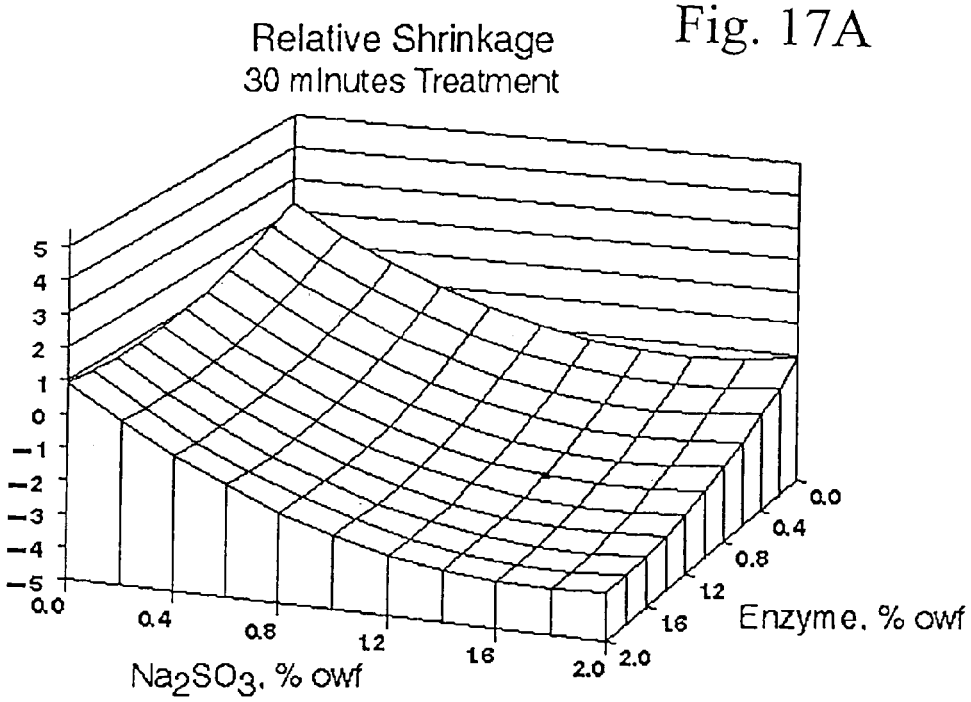
FIG. 17 shows central composite design for enzymatic treatment of wool fabric with 1.0% owf enzyme, 1.4% owf sodium sulfate for 30 minutes, resulting in predictive surface responses: (a) relative shrinkage, −3.01%; (b) breaking load, 22.9%, and © weight loss, 3.71%.
Figure 17B:
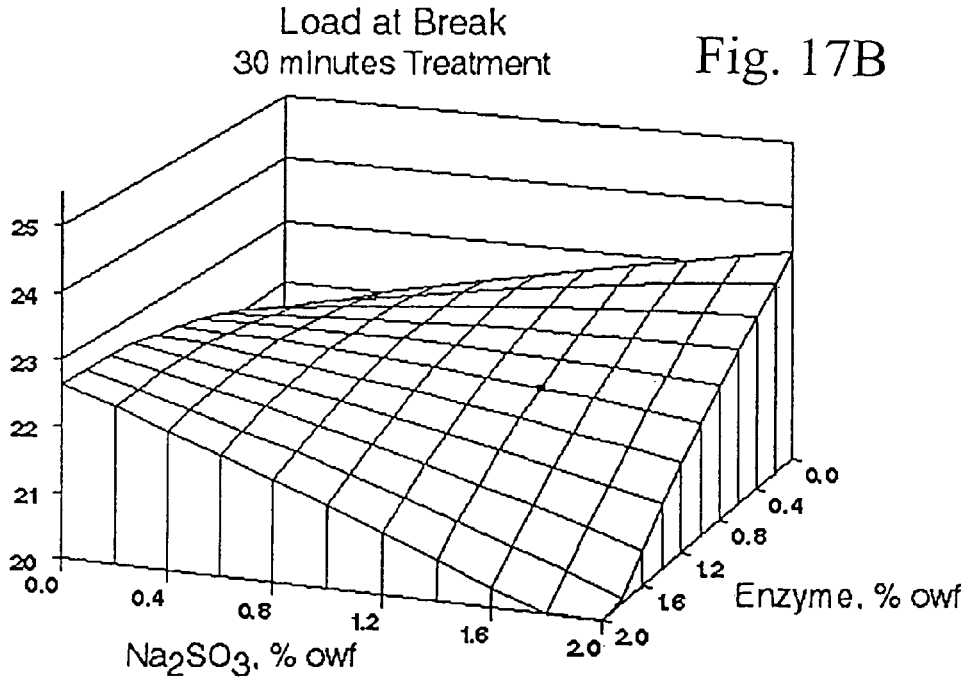
Figure 17C:
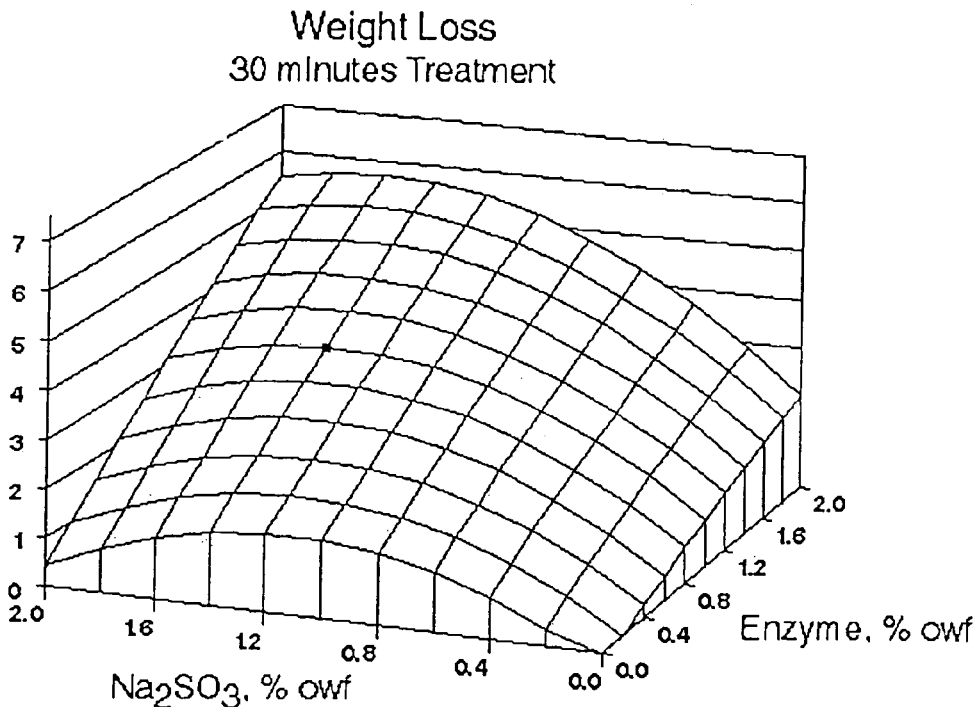

Graphical analysis of the data in FIGS. 17 (*a, b*, and *c*) according to Equation 1 from the central composite design predicts that for treatment with 1% enzyme and 1.4% sodium sulfite, applied for 30 minutes, maximum relative shrinkage of −3.01% is obtained with resultant breaking load of 22.92%, and a weight loss of 3.71%.

Conclusions:

A combined process for bleaching, shrinkage control, and biopolishing has been established utilizing pretreatment with hydrogen peroxide, gluconic acid, and dicyandiamide followed by treatment with alkaline protease and sodium sulfite applied in triethanolamine buffer. An imbedded fractional factorial design with center points was used to design experiments with various amounts of enzyme, sodium sulfite and exposure times from 20 to 60 minutes to obtain a reponse surface for relative shrinkage. The graphic depiction of the response surface predicted that maximum shrinkage control of −3.01% resulted from treatment with 1.0% owf enzyme and 1.4% owf sodium sulfite applied for 30 minutes. Treatments for 20, 40, 50 and 60 minutes at various concentrations of enzyme and sodium sulfite gave similar responses. Under these optimum treatment conditions, mechanical properties were not affected; however, there was 3.71% weight loss. Whiteness Index increased 75.4%+/−2.39% after pretreatment. When pretreatment was followed by treatment with 1.5% owf enzyme and 1.5% owf sodium sulfite, the change in Whiteness Index (with reference to the control fabric) was 94.4%+/−3.78%.

A count of projecting fiber ends above the surface of the washed fabrics revealed that wool fabrics treated with both enzyme and sodium sulfite at combinations of 0.5% owf and 1.5% owf gave the smoothest surfaces. Evaluation of these fabrics by visual perception and fabric handle supported these results.

The scanning electron photomicrographs of the treated fabrics revealed obvious scale smoothing, most pronounced in pretreated wool fibers that were treated with 1.5% owf enzyme and 1.5% owf sodium sulfite.

The response surface for relative shrinkage showed that all treatments resulted in negative shrinkage values to indicate that the fabrics increased in size. This was indeed the case. Without being bound by theory, we speculate that pretreatment with $H_2O_2$, GA, and DD, followed by treatment with enzyme and sodium sulfite opens the morphological structure of the fiber, causing the yarns to occupy a larger space within the fabric. Given that the fibers have been smoothed and there is no appreciable shrinkage, these yarns are free to move apart and occupy a larger area.

Application of this system produced no loss in the mechanical strength and elongation of the fabrics. It is interesting to note that there was significant decrease in Young's modulus of the fabrics treated with equal and/or low amounts of enzyme and sodium sulfite, which indicated that they were not as stiff as their untreated counterparts.

The reported two-step beaching and biopolishing system can be recommended for shrinkage control in wool fabrics.

Third Example

Enzymes other than alkaline protease (e.g., Esperase® which is a serine protease) may be utilized in the present invention. For example, the cystine protease papain may be utilized. A Rotatable Central Composite statistical design consisting of 31 experiments was utilized to investigate the importance of various concentrations of papain and other treatment bath constituents for achieving shrinkage control, smooth handle and whiteness.

Treatments were carried out using woven wool fabrics (TF523). Pretreatment was similar to that used in the $H_2O_2$/Esperase® systems where 1L pretreatment bath contained the formulation as follows: 3 g/l NaOH, dicyandiamide, 1 g/l gluconic acid, 1 g/l triethanolamine, 20 ml/l $H_2O_2$ (30%), 2 g/l Triton X-114, LR: 25:1. Pretreatment and papain treatments were carried out in LP2. Pretreatment was applied for 40 minutes at 30° C. after which the samples were rinsed in cold water. The pretreated samples were squeezed to remove excess water and sequentially treated with the papain systems Treatment with Papain was as follows: 1.2 g/l papain (crude powder from Sigma, 2.1 units/mg solid) 3% owf, 0.4 g/l Na2SO3 (1% owf), 0.1 g/l cystein (0.25% owf), 0.3 g/l ascorbic acid (0.75% owf), 1 g/l Triton X-114, 10 ml/l phosphate buffer (pH 7.0), LR: 1:25. The papain treatment was carried out for 60 minutes at 50° C., followed by rinsing in cold water and air-drying. The phosphate buffer was prepared as follows 276 g $NaH_2PO_4.H_2O$, 60 g NaOH, 42 g EDTA-4Na.$2H_2O$, added water to total 1L.

Property values for the pretreated/treated fabrics:

| Properties | Blank | Treated samples |
|---|---|---|
| Weight loss (%) | 1.4 | 3.2 |
| Dry burst strength loss (%) | 8.4 | −0.3 |
| Wet burst strength loss (%) | 1.8 | 9.6 |
| Shrinkage (%) | 8.9 | −2.1 |
| Whiteness increase (%) | 3.2 | 63.3 |
| Yellowness decrease (%) | 1.8 | 24.2 |

After 5 circles washing, there was no evidence of pilling; however untreated, blank and only pretreated all became fuzzed. Under these pretreatment/treatment conditions, the fabrics showed soft handle. Higher concentrations of papain and sulfite caused the stiff fabric handle.

Fourth Example

Seven different groups of woven fabrics were chosen for pretreatment and enzyme treatment, including TF154 Spun Acetate (Di-) Suiting, Bright luster, ISO 105/F07, 10"L×9"W; 4006 Unbleached 100% Cotton, 13"L×12"W; TF361 Spun Nylon 6.6 Dupont Type 2, 10"L×9"W; TF Polyester, unsoiled STC WFK 30A, 10"L×9"W; TF266 Spun Viscose Challis, 12"L×10"W; TF 4504 Union Cloth 62% Wool Warp/38% Cotton Filling, 12"L×10"W; and Forstmann 50% Wool/48% Nomex Nylon/1% Kevlar/1% Conducting Fiber. The weight of the samples was about 10 grams, the weight of nylon fabric sample was 7.5 grams, and the weight of wool/kevlar sample was 14 grams. Each group included 8 pieces of fabric samples, 4 samples were carried out for enzyme treatment and the other 4 pieces were used for control sample. Two enzyme treated and two control samples were utilized for shrinkage testing, the other two treated and two control samples were used for measuring tensile strength.

The method of the present invention was applied to all groups of woven fabric samples with liquor ratio of 10:1. All pretreatment and enzyme treatment were carried out in LP2 Launder-Ometer and Lab Dyeing system. The whiteness index of the fabric samples was measured before and after enzyme treatment using Color-insights™ QC Manager Software (BYK-Gardner, Inc.). The tensile strength was tested for both treated and control samples before machine wash and dry process using ATSM Test Methods D 1682-64 for Breaking Load and Elongation of Textile Fabrics. AATCC Test Method 135-1992, Dimensional Change in Automatic Home Laundering of Woven and Knit Fabrics, "Alternative Washing and Drying Conditions" was used to determine the area shrinkage after 5 machine wash/tumble dry cycles.

Property Measurements:

The following table shows the different of whiteness/yellowness index of the treated samples; there is obvious improvement of the whiteness of cotton, viscose and wool/cotton fabrics after enzyme treatment, the whiteness of treated acetate and nylon also increased visually:

Differences in Whiteness/Yellowness Index of Treated Fabrics

| Sample | WI | WI STDEV | YI | YI STDEV |
|---|---|---|---|---|
| Acetate | 6.82 | 0.628 | −1.84 | 0.288 |
| Cotton | 36.25 | 0.207 | −9.69 | 0.247 |
| Nylon | 6.74 | 2.321 | −2.28 | 0.309 |
| Polyester | 1.18 | 0.601 | −0.20 | 0.156 |
| Viscose | 13.52 | 0.662 | −2.71 | 0.191 |
| Wool/Cotton | 27.08 | 0.535 | −8.04 | 0.195 |
| Wool/Nomex/ | Δ K/S | K/S STDEV | | |
| Kevlar | 2.43 | 0.192 | | |

The result of area shrinkage after 5 machine wash/dry cycles is shown in the following table. The area shrinkage of enzyme treated cotton, viscose and wool/cotton fabric reduced 8.42%, 17.95% and 10.36% respectively; the area shrinkage of acetate, nylon and wool/kevlar fabric after enzyme treatment also improved to some extent. The appearance of the fabric after 5 machine wash/dry cycles had some changes, more wrinkle of treated acetate after 5 machine wash/dry cycles compared to the control fabric and less wrinkle of treated viscose after machine wash/dry cycles.

Area Shrinkage Percentage after 5 Machine Wash/Dry Cycles

| Sample | | Area Shrinkage (%) After 5 wash/dry | Area Shrinkage (%) STDEV |
|---|---|---|---|
| Acetate | Treated | 3.85 | 0.148 |
| | Control | 9.11 | 0.488 |
| Cotton | Treated | 1.28 | 0.269 |
| | Control | 9.70 | 0.481 |
| Nylon | Treated | 0.63 | 0.283 |
| | Control | 4.01 | 0.134 |

-continued

| Sample | | Area Shrinkage (%) After 5 wash/dry | Area Shrinkage (%) STDEV |
|---|---|---|---|
| Polyester | Treated | 0.42 | 0.311 |
| | Control | 0.78 | 0 |
| Viscose | Treated | 0.67 | 0.170 |
| | Control | 18.62 | 0.057 |
| Wool/Cotton | Treated | 1.16 | 0.665 |
| | Control | 11.52 | 1.202 |
| Wool/Nomex/ | Treated | 0.25 | 0.219 |
| Kevlar | Control | 1.41 | 0.217 |

The breaking tensile strength of nylon fabric after enzyme treatment and before machine wash increased about 17%; the tensile strength of treated cotton fabric also increased 4%. There is almost no change of tensile strength for acetate and little decrease of tensile strength for polyester fabric. The tensile strength of enzyme treated viscose and wool/cotton fabric reduced 7% and 11% respectively shown in the following table. Since the pretreatment and enzyme treatment process has caused the pre-shrinkage of the fabric, the corrected breaking strength is also shown in the following table.

Change of Tensile Strength after Enzyme Treatment

| Sample | | Tensile Strength (kg) After treatment Before wash/dry | Tensile Strength STDEV | Tensile Strength Change (%) | Corrected Tensile Strength (lb/yarn) |
|---|---|---|---|---|---|
| Acetate | Treated | 24.11 | 0.297 | +3.39 | 1.23 |
| | Control | 23.32 | 1.810 | | 1.24 |
| Cotton | Treated | 22.71 | 0.495 | +4.70 | 0.57 |
| | Control | 21.69 | 0.467 | | 0.56 |
| Nylon | Treated | 53.08 | 0.877 | +17.28 | 2.25 |
| | Control | 45.26 | 0.764 | | 1.92 |
| Polyester | Treated | 52.74 | 0.141 | −2.15 | 1.63 |
| | Control | 53.90 | 1.273 | | 1.67 |
| Viscose | Treated | 22.79 | 0.325 | −7.02 | 0.68 |
| | Control | 24.51 | 0.071 | | 0.74 |
| Wool/Cotton | Treated | 17.85 | 0.297 | −10.71 | 0.69 |
| | Control | 19.99 | 0.129 | | 0.83 |
| Wool/Nomex/ | Treated | *40.76 | 0.170 | −5.60 | 1.47 |
| /Kevlar | Control | *43.18 | 0.186 | | 1.56 |

*The tensile strength of wool/nomex/Kevlar was measured after 5 machine wash/dry cycles All of the references cited herein are incorporated by reference in their entirety. Also incorporated by reference in their entirety are the following references: U.S. Pat. No. 6,140,109; Bell, V. A., et al., Proceedings of the 7th International Wool Textile Research Conference, Tokyo, IV, 292–301 (1985); Bellamy, L. J., The Infra-red Spectra of Complex Molecules, New York: John Wiley Press, 163–164, 167, 173, (1966); Bourn, A., et al., Proceedings of the 7th International Wool Textile Research Conference, Tokyo, IV, 272–279 (1985); Byrne, K. M., et al., Soft Finishes for Wool, Proc. Textile Fashioning the Future, The Textile Institute, U.K., 317–325 (1989); Cegarra, J and Gacén, J., The Bleaching of Wool with Hydrogen Peroxide, Wool Science Review 59, International Wool Secretariat, Yorks (1983); Choplin, H., Introduction to the Proteases, University of Tours: Francois Rabelais, http://delphi.phys.univ-tours.fr/Prolysis/introprotease.html, 1999; Cockett, K. R. F., Production of Superwash Knitwear by Batch Processing Routes, Wool Science Review 56, International wool Secretariat, Ilkley, pp. 3–44 (1980); Davidson, A. N. and Preston, R., J. Text. Inst., 47, 685–703 (1956); Evans, D. J. and Lanczki, M., Textile Res. J., 67, (6), 435–444 (1997); Evans, D. J., et al., Proceedings of the 7th International Wool Textile Research Conference, Tokyo, Vol. 1, 135–142 (1985); Fornelli, S., The Enzymatic Big Bang for the Textile Industry, Sandoz Chemicals, LTD. 05994.00.94e, Muttenz, Switzerland, 36,37 (1994); Gerhartz, W. (Ed.), Enzymes in Industry, VCH Verlagsgesellschaft mbH, D-6940 Weinheim, Germany, 1990; K. Cockett, et al., Proc. 6th International Wool Textile Research Conference, Petoria, S. Africa, V1, 1–16 (1980); Keith, R. F., et al., J. Soc. Dyers Colourists, 96, (5) 214–223 1980; Leeder, J. D., et al., Proceedings of the 7th International Wool Textile Research Conference, Tokyo, IV, pp. 312–321 (1985); Levene, R., et al., Applying Proteases to Confer Improved Shrink-resistance to Wool, J. Soc. Dyers Colourists, 112, (1) 6–10 1996; Lipson, M., Unshrinkable Wool Produced by Alcoholic Alkali, J. Text. Inst., 38, (8), 279–285 (1947); McDevitt, J. P. and Shi, X. C., Method for Treatment of Wool, U.S. Pat. No. 6,099,588, Novo Nordisk Biochem North America, Franklinton, N.C., 1999; Mehta, R. D., Proceedings of the 7th International Wool Textile Research Conference, Tokyo, IV, 262–271 (1985); O'Connor, R. T., Field, E. T., and Singleton, S., J. Amer. Oil Chem. Soc., 28(4) 154–160 (1951); Rensburg, N. and Barkhuysen, F., Proceedings of the 7th International Textile Wool Research Conference, Tokyo, IV, 302–311 (1985); Rutley, R. O., J. Soc. Dyers Colourists, 86(8), 337–345 (1970); Sinclair, R. G., et al., J. Amer. Chem. Soc. 74, 10 2570–2578 (1952); Stigter, D., J. Amer. Oil. Chem. Soc. 48(7), 340–343 (1971); Sun, K., Zhou, W., and Wang, J., Book of Papers 1998 International AATCC Conference & Exhibition, Philadelphia, 299–309 (1998); Sweetman, B. J., and Maclaren, J. A., Textile Res. J. 35(4), 315–322 (1965); Weck, M., Textile Praxis International 53, 144–147 (1991); Wood, F. C., J. Soc. Dyers Colourists 68(12) 485–495 1952; Zahn, H., et al., Textile Res. J. 64(9), 554–555 (1994); Box, G. E. P., Hunter, W. G., and Hunter, J. S., Statistics for Experimenters, An Introduction to Design, Data Analysis, and Model Building, Chapter 15, John Wiley & Sons, NY, 653, (1978); El-Sayed, H., et al., Coloration Technology, 117 (4), 234–238 (2001); Guise, G. B., and Smith, G. C., Journal of Applied Polymer Science, 30, 4099–4111. (1985); Hanekom, E. C., and Barkhuysen, F. A., SAWTRI Bulletin, 8 (2), 19–21 (1974); Jovan I., et al., J. Text. Inst., 89 Part 1, (2), 390–400 (1998); Lewis, J., Wool Science Review 55, 23–42 (1978); Lewis, J., Wool Science Review 54, 3–29 (1977); Weideman, E. and Grabherr, H., SAWTRI Bulletin, 10 (2), 22–26 (1976); and Weideman, E., and Grabherr, H., SAWTRI Bulletin, 8 (2), 22–27 (1974).

Thus, in view of the above, the present invention concerns (in part) the following:

A method of improving shrink-resistance of (or a method of treating) natural fibers, synthetic fibers, or mixtures thereof, or fabrics or yarns composed of natural fibers, synthetic fibers, or blends thereof, comprising (or consisting essentially of or consisting of) contacting fibers (or fabric or yarn) with NaOH, $H_2O_2$, gluconic acid dicyandiamide, and non-ionic surfactant, and optionally subsequently contacting the fibers (or fabric or yarn) with protease and non-ionic surfactant and optionally sodium sulfite and optionally triethanolamine and optionally polyacrylamide polymer; said method does not utilize dichloroisocyanuric acid.

The above method, wherein said method does not utilize dichloroisocyanuric acid, chloroamines, peroxymonosulfuric acid, monoperoxyphthalic acid, permanganate, chlorine gas, sodium hypochlorite, or aminoplast resins.

The above method, wherein said non-ionic surfactant is an alkylaryl polyether alcohol having the following structural formula:

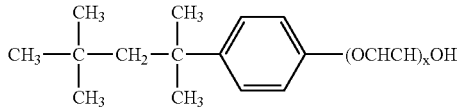

in which x indicates the average number of ethylene oxide units in the ether side chain and x ranges from 7 to 10.

The above method, wherein x is 7 to 8 or 9 to 10.

The above method, said method comprising (or consisting essentially of or consisting of) contacting the fibers (or fabric or yarn) with NaOH, $H_2O_2$, gluconic acid, dicyandiamide, and non-ionic surfactant, and subsequently contacting the fibers (or fabric or yarn) with protease and optionally sodium sulfite and optionally triethanolamine and optionally polyacrylamide polymer.

The above method, wherein said non-ionic surfactant is an alkylaryl polyether alcohol having the following structural formula:

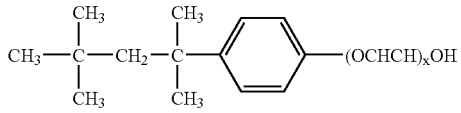

in which x indicates the average number of ethylene oxide units in the ether side chain and x ranges from 7 to 10.

The above method, wherein x is 9 to 10.

The above method, said method comprising (or consisting essentially of or consisting of) contacting the fibers (or fabric or yarn) with NaOH, $H_2O_2$, gluconic acid, dicyandiamide, and non-ionic surfactant; said method does not utilize protease.

The above method, wherein said non-ionic surfactant is an alkylaryl polyether alcohol having the following structural formula:

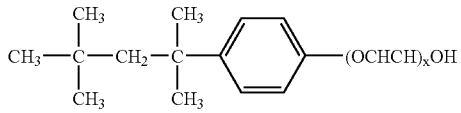

in which x indicates the average number of ethylene oxide units in the ether side chain and x ranges from 7 to 10.

The above method, wherein x is 7 to 8.

The above method, said method comprising (or consisting essentially of or consisting of) contacting the fibers (or fabric or yarn) with NaOH, $H_2O_2$, gluconic acid, dicyandiamide, and non-ionic surfactant, and subsequently contacting the fibers (or fabric or yarn) with protease, sodium sulfite, triethanolamine, and Triton X-114, and optionally polyacrylamide polymer.

The above method, wherein said non-ionic surfactant is an alkylaryl polyether alcohol having the following structural formula:

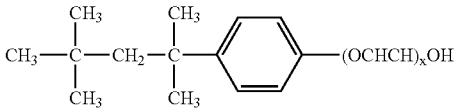

in which x indicates the average number of ethylene oxide units in the ether side chain and x ranges from 7 to 10.

The above method, wherein x is 7 to 8.

Products produced by the above methods.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

TABLE I

Sequential treatments of wool fabrics for shrinkage control following a seven-factorial design.

| | Step 1: Pretreatment* | | | | | | Step 2: |
|---|---|---|---|---|---|---|---|
| Experiments (Rows) | X1 pH* NaOH (g/L) | X2 Liquor Ratio | X3 time, min. | X4 GA (g/L) | X5 DD (g/L) | X6 $H_2O_2$ (30% w/v) | Treatment X7 Enzyme (% owf) |
| 1 | 1 | 1:20 | 20 | 1 | 3 | 20 ml/L | 0 |
| 2 | 3 | 1:20 | 20 | 0 | 0 | 20 ml/L | 2 |
| 3 | 1 | 1:30 | 20 | 0 | 3 | 0 | 2 |
| 4 | 3 | 1:30 | 20 | 1 | 0 | 0 | 0 |
| 5 | 1 | 1:20 | 40 | 1 | 0 | 0 | 2 |

TABLE I-continued

Sequential treatments of wool fabrics for shrinkage control following a seven-factorial design.

| | Step 1: Pretreatment* | | | | | | Step 2: |
|---|---|---|---|---|---|---|---|
| Experiments (Rows) | X1 pH* NaOH (g/L) | X2 Liquor Ratio | X3 time, min. | X4 GA (g/L) | X5 DD (g/L) | X6 $H_2O_2$ (30% w/v) | Treatment X7 Enzyme (% owf) |
| 6 | 3 | 1:20 | 40 | 0 | 3 | 0 | 0 |
| 7 | 1 | 1:30 | 40 | 0 | 0 | 20 ml/L | 0 |
| 8 | 3 | 1:30 | 40 | 1 | 3 | 20 ml/L | 2 |

*pH range for NaOH: 11.4 to 12.2.

TABLE II

The Physical Properties of Samples Treated in Experiments 1–8 and the Control.

| Experiments (Rows) | Weight loss (%) | ΔThickness (%) | ΔRegain (%) | Shrinkage (%) | ΔWI (%) | ΔYI (%) | Strength (Kg) |
|---|---|---|---|---|---|---|---|
| 1 | 1.18 | 31.9 | 10.2 | 9.16 | −4.01 | 0.03 | 20.8 |
| 2 | 22.3 | 0.17 | 7.86 | 5.16 | 144 | −32.5 | 6.40 |
| 3 | 23.1 | 7.65 | 8.52 | 12.4 | 64.1 | −16.5 | 4.50 |
| 4 | 1.73 | 60.0 | 10.3 | 30.6 | −77.4 | 20.9 | 17.3 |
| 5 | 27.0 | −1.74 | 5.37 | 11.6 | 72.9 | −19.6 | 4.80 |
| 6 | 1.72 | 65.6 | 7.62 | 35.7 | −60.4 | 15.1 | 16.9 |
| 7 | 0.56 | 36.9 | 10.9 | 9.27 | 27.6 | −7.40 | 19.8 |
| 8 | 39.0 | −21.4 | 10.6 | −0.86 | 194.7 | −45.9 | 5.20 |
| control | na | na | na | 21.2 | na | na | 20.6 |

TABLE III

Importance of Factors from Treatments 1 to 8 of Table I.

| Factors | Weight loss (%) | ΔThickness (%) | ΔRegain (%) | Relative Shrinkage (%) | ΔWhiteness (%) | ΔYellowness (%) | Strength, Maximum Load (Kg) |
|---|---|---|---|---|---|---|---|
| X1 | 12.9 | 29.6 | 1.42 | 28.2 | 40.4 | 1.15 | −4.10 |
| X2 | 12.2 | −12.7 | 9.24 | −10.2 | 56.5 | −11.9 | −2.10 |
| X3 | 19.9 | −20.4 | −2.50 | −1.60 | 108 | −29.6 | −2.30 |
| X4 | 21.2 | −41.6 | 1.64 | −12.0 | 10.7 | −3.35 | 0.50 |
| X5 | 13.4 | −11.6 | 2.50 | −0.30 | 27.4 | −8.67 | −0.90 |
| X6 | 9.52 | −83.9 | 7.68 | −67.6 | 363 | −85.5 | 8.70 |
| X7 | 106 | −209 | −6.72 | −56.5 | 589 | −143 | −53.9 |

TABLE IV

Area Shrinkage (%) of samples treated in Table I.

| Experiments (Rows) | Initial Shrinkage (%) | Relative Shrinkage (%) | Overall Shrinkage (%) |
|---|---|---|---|
| 1 | 18.3 | 9.16 | 25.8 |
| 2 | 10.7 | 5.16 | 15.3 |
| 3 | 17.9 | 12.4 | 28.1 |
| 4 | 27.7 | 30.6 | 49.8 |
| 5 | 16.6 | 11.6 | 26.3 |
| 6 | 29.8 | 35.7 | 54.9 |
| 7 | 18.5 | 9.27 | 26.1 |
| 8 | 5.04 | −0.86 | 4.22 |
| Control | na | 21.2 | 21.2 |

TABLE V

Treatments without Enzyme, 30° C., 30 minutes.

| Sample | NaOH g/L | Triton X-114 2 g/L | GA g/L | DD g/L | $H_2O_2$ (30% w/v) |
|---|---|---|---|---|---|
| 61 | 1 | 2 | 1 | 3 | 20 ml/l |
| 79 | 3 | 2 | 1 | 3 | 20 ml/l |
| 101 | Blank: processing conditions without additives | | | | |

TABLE VI

Physical Properties of Fabrics Treated According to Treatments in Table V.

| Sample | Weight loss (%) | ΔThickness (%) | ΔRegain (%) | Relative Shrinkage (%)* | ΔWhiteness (%) | ΔYellowness (%) | Strength (Kg) |
|---|---|---|---|---|---|---|---|
| 61 | 0.60 | 15.3 | 12.30 | 7.34 | 69.5 | −14.7 | 21.6 |
| 79 | 0.94 | 14.6 | 8.20 | 2.95 | 76.6 | −18.4 | 21.4 |
| 101 | 0.08 | 8.64 | −2.34 | 13.7 | 37.7 | −8.06 | 18.8 |

*Initial and overall shrinkages (not shown in Table 6) are as follows:

#61 = 7.96% and 14.3%;

#79 = 7.59% and 10.3%;

Blank = 6.71% and 19.5%, respectively.

TABLE VII

Enzyme System with PAA/Triton X-114.

| Pretreatment* (#61) | NaOH 1 g/l | Triton X-114 2 g/L | GA 1 g/l | DD 3 g/l | $H_2O_2$ (30% w/v) 20 ml/l |
|---|---|---|---|---|---|
| Treatment (#51) | Triton X-114, 1 g/L<br>PAA, 2% owf<br>No enzyme | | | | |
| Treatment (#57) | Triton X-114, 1 g/L<br>PAA, 2% owf<br>1.5 g/L enzyme | | | | |
| Treatment (#99) | Triton X-114, 1 g/L<br>PAA, 2% owf<br>enzyme, 2.0% owf, together with 2% owf $Na_2SO_3$ | | | | |

*Pretreatment #61 was used for PAA/Triton X114 treatments, #51, #57, and #99.

TABLE VIII

Property Values of Fabrics Treated According to Table VII.

| Sample | Weight Loss, % | Δ Thickness | Δ Regain | Shrinkage, % | Δ Whiteness | Δ Yellowness | Strength (Kg) | Initial Shrinkage, % | Relative Shrinkage, % | Overall Shrinkage, % |
|---|---|---|---|---|---|---|---|---|---|---|
| 51 | −1.43 | 28.6 | −7.86 | 6.61 | 76.5 | −14.8 | 23.1 | 10.7 | 6.61 | 16.6 |
| 57 | 0.37 | 27.1 | −9.08 | 7.73 | 127 | −23.7 | 21.2 | 7.44 | 7.73 | 14.6 |
| 99 | 5.41 | 26.0 | −11.9 | 1.16 | 205 | −40.8 | 15.0 | 8.88 | 1.16 | 9.94 |
| Blank | −1.34 | 25.9 | −12.3 | 21.9 | 22.6 | −8.34 | 16.6 | 11.3 | 21.9 | 30.7 |

TABLE IX

Central Composite Design for Enzymatic Treatment.

| Run | $Na_2SO_3$ (% owf) | Enzyme (% owf) | Time (Minutes) |
|---|---|---|---|
| 1 | 0.5 | 0.5 | 30 |
| 2 | 0.5 | 0.5 | 50 |
| 3 | 0.5 | 1.5 | 30 |
| 4 | 0.5 | 1.5 | 50 |
| 5 | 1.5 | 0.5 | 30 |
| 6 | 1.5 | 0.5 | 50 |
| 7 | 1.5 | 1.5 | 30 |

TABLE IX-continued

Central Composite Design for Enzymatic Treatment.

| Run | $Na_2SO_3$ (% owf) | Enzyme (% owf) | Time (Minutes) |
|---|---|---|---|
| 8 | 1.5 | 1.5 | 50 |
| 9 | 0.0 | 1.0 | 40 |
| 10 | 2.0 | 1.0 | 40 |
| 11 | 1.0 | 0.0 | 40 |
| 12 | 1.0 | 2.0 | 40 |
| 13+ | 1.0 | 1.0 | 20 |
| 14+ | 1.0 | 1.0 | 60 |
| 15+ | 1.0 | 1.0 | 40 |
| 16+ | 1.0 | 1.0 | 40 |
| 17+ | 1.0 | 1.0 | 40 |
| 18+ | 1.0 | 1.0 | 40 |
| 19+ | 1.0 | 1.0 | 40 |
| 20+ | 1.0 | 1.0 | 40 |
| * | P | Only pretreatment | |

TABLE IX-continued

Central Composite Design for Enzymatic Treatment.

| Run | $Na_2SO_3$ (% owf) | Enzyme (% owf) | Time (Minutes) |
|---|---|---|---|
| ** | B | Blank | |
| *** | C | Control, wash/dry | |

Figure 15:
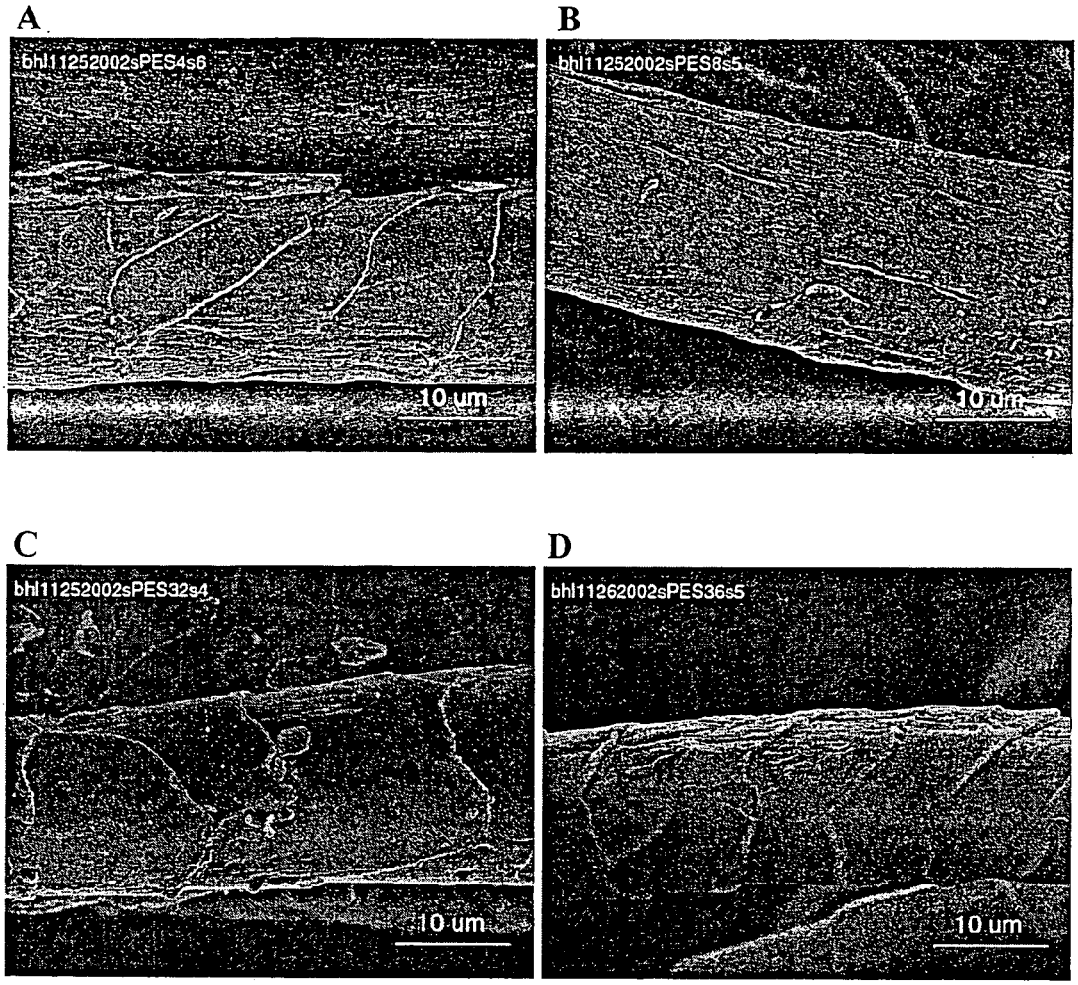
FIG. 15 shows scanning electron photomicrographs of wool fibers: (a, b, and c) treatment with enzyme and sodium sulfite; (d) treatment with enzyme alone; (e) treatment with sodium sulfite alone; (f) control.
Figure 15:
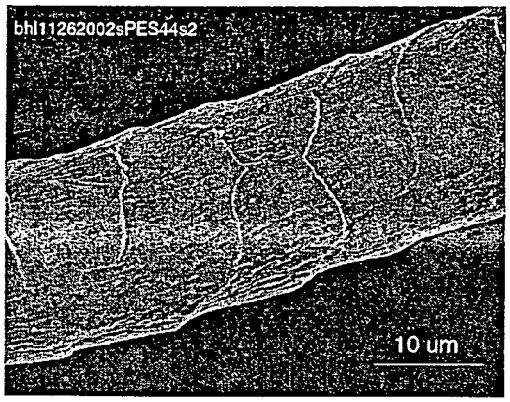
Figure 15:
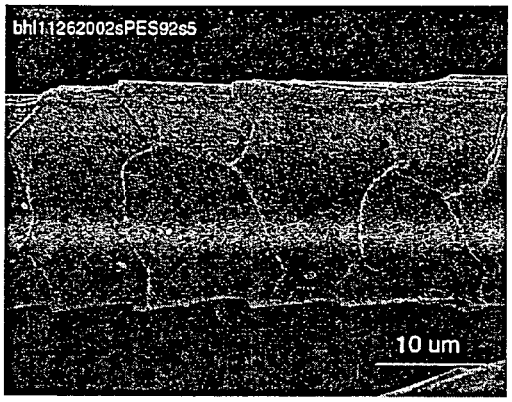

*Samples "P" were only pretreated with alkaline peroxide/DD/GA system without further enzymatic treatment for 30 minutes.
**Samples "B" as the blank were pretreated and treated using the same conditions with Run 1–20 but only with water in the treatment bath for 30 minutes.
***Samples "C" were not treated but washed 5 times and air-dried.
+These runs represent the center points for estimating curvature in the construction of the 3D graphs for the central composite design FIG. 15.

We claim:

1. A method of improving shrink-resistance of natural fibers, synthetic fibers, or mixtures thereof, or fabrics or yarns composed of natural fibers, synthetic fibers, or blends thereof, comprising contacting said fibers or fabric or yarn with a bath consisting essentially of water, NaOH, $H_2O_2$, gluconic acid, dicyandiamide, and non-ionic surfactant, rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer.

2. The method according to claim 1, wherein said non-ionic surfactant is an alkylaryl polyether alcohol having the following structural formula:

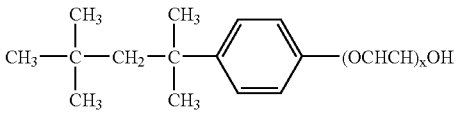

in which x indicates the average number of ethylene oxide units in the ether side chain and x ranges from 7 to 10.

3. The method according to claim 2, wherein x is 9 to 10.

4. The method according to claim 2, wherein x is 7 to 8.

5. The method according to claim 1, said method comprising contacting said fibers or fabric or yarn with a bath consisting essentially of water, NaOH, $H_2O_2$, gluconic acid, dicyandiamide, and non-ionic surfactant, rinsing said fibers or fabric or yarn and subsequently contacting said fibers or fabric or yarn with a bath consisting essentially of water protease, sodium sulfite, triethanolamine, non-ionic surfactant, and polyacrylamide polymer.

6. The method according to claim 1, wherein said method does not utilize dichloroisocyanuric acid, chloroamines, peroxymonosulfuric acid, monoperoxyphthalic acid, permanganate, chlorine gas, sodium hypochlorite, or aminoplast resins.

7. The method according to claim 2, wherein x is 7 to 8 or 9 to 10.

8. A product produced by the method according to claim 1.

9. The method according to claim 1, said method consisting essentially of contacting said fibers or fabric or yarn with a bath consisting essentially of water, NaOH, $H_2O_2$, gluconic acid, dicyandiamide, and non-ionic surfactant, rinsing said fibers or fabric or yarn and subsequently contacting said fibers or fabric or yarn with a bath consisting essentially of water, protease and optionally sodium sulfite and optionally triethanolamine and optionally polyacrylamide polymer.

10. The method according to claim 1, said method consisting essentially of contacting said fibers or fabric or yarn with a bath consisting essentially of water, NaOH, $H_2O_2$, gluconic acid, dicyandiamide, and non-ionic surfactant, rinsing said fibers or fabric or yarn and subsequently contacting said fibers or fabric or yarn with a bath consisting essentially of water, protease, sodium sulfite, triethanolamine, non-ionic surfactant, and polyacrylamide polymer.

11. The method according to claim 1, said method comprising contacting said fibers or fabric or yarn with a bath consisting essentially of water, NaOH, $H_2O_2$, gluconic acid, dicyandiamide, and non-ionic surfactant at a temperature between about 30° C. and about 45° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer.

12. The method according to claim 1, said method comprising contacting said fibers or fabric or yarn with a bath consisting essentially of water, NaOH, $H_2O_2$, gluconic acid, dicyandiamide, and non-ionic surfactant at 30° C.–45° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer.

13. The method according to claim 1, said method comprising contacting said fibers or fabric or yarn with a bath consisting essentially of water, NaOH, $H_2O_2$, gluconic acid, dicyandiamide, and non-ionic surfactant at a temperature between about 30° C. and about 40° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer.

14. The method according to claim 1, said method comprising contacting said fibers or fabric or yarn with a bath consisting essentially of water NaOH, $H_2O_2$, gluconic acid, dicyandiamide, and non-ionic surfactant at 30° C.–40° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer.

15. The method according to claim 1, said method comprising contacting said fibers or fabric or yarn with a bath consisting essentially of water, NaOH, $H_2O_2$, gluconic acid, dicyandiamide, and non-ionic surfactant at a reaction temperature between about 30° C. and about 45° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer at a temperature between about 40° C. and about 55° C.

16. The method according to claim 1, said method comprising contacting said fibers or fabric or yarn with a bath consisting essentially of water, NaOH, $H_2O_2$, gluconic acid, dicyandiamide, and non-ionic surfactant at a reaction temperature between about 30° C. and about 45° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer at 40° C.–55° C.

17. The method according to claim 1, said method comprising contacting said fibers or fabric or yarn with a bath consisting essentially of water, NaOH, $H_2O_2$, gluconic acid, dicyandiamide, and non-ionic surfactant at a reaction temperature between about 30° C. and about 45° C., rinsing said fibers or fabric or yarn and subsequently contacting said fibers or fabric or yarn with a bath consisting essentially of water, protease and non-ionic surfactant and optionally sodium sulfite and optionally triethanolamine and optionally polyacrylamide polymer at a temperature between about 40° C. and about 55° C. and subsequently inactivating said protease.

18. The method according to claim 1, wherein said method comprises contacting said fibers or fabric or yarn with a bath consisting essentially of water, NaOH, $H_2O_2$, gluconic acid, dicyandiamide, and non-ionic surfactant, rinsing said fibers or fabric or yarn and subsequently contacting said fibers or fabric or yarn with a bath consisting of water, protease and non-ionic surfactant and optionally sodium sulfite and optionally triethanolamine and optionally polyacrylamide polymer.

19. The method according to claim 1, wherein said method comprises contacting said fibers or fabric or yarn with a bath consisting of water, NaOH, $H_2O_2$, gluconic acid, dicyandiamide, and non-ionic surfactant, rinsing said fibers or fabric or yarn and subsequently contacting said fibers or fabric or yarn with a bath consisting of water, protease and non-ionic surfactant and optionally sodium sulfite and optionally triethanolamine and optionally polyacrylamide polymer.

20. The method according to claim 1, wherein said natural fibers are selected from the group consisting of wool, wool fibers, and animal hair.

21. The method according to claim 1, said method comprising contacting said fibers or fabric or yarn with a bath consisting essentially of water, NaOH, $H_2O_2$, gluconic acid, dicyandiamide, and non-ionic surfactant, rinsing said fibers or fabric or yarn and subsequently contacting said fibers or fabric or yarn with a bath consisting essentially of water, protease, triethanolamine, non-ionic surfactant, polyacrylamide polymer, and optionally sodium sulfite.

* * * * *